US008807827B2

(12) United States Patent
Koda et al.

(10) Patent No.: US 8,807,827 B2
(45) Date of Patent: Aug. 19, 2014

(54) DETENT ESCAPEMENT AND MECHANICAL TIMEPIECE

(75) Inventors: Masayuki Koda, Chiba (JP); Hiroki Uchiyama, Chiba (JP); Takashi Niwa, Chiba (JP)

(73) Assignee: Seiko Instruments Inc. (JP)

( * ) Notice: Subject to any disclaimer, the term of this patent is extended or adjusted under 35 U.S.C. 154(b) by 53 days.

(21) Appl. No.: 13/581,897

(22) PCT Filed: Aug. 31, 2010

(86) PCT No.: PCT/JP2010/064819

§ 371 (c)(1),
(2), (4) Date: Nov. 8, 2012

(87) PCT Pub. No.: WO2011/111250

PCT Pub. Date: Sep. 15, 2011

(65) Prior Publication Data

US 2013/0070571 A1 Mar. 21, 2013

(30) Foreign Application Priority Data

Mar. 10, 2010 (JP) ..... 2010-053313

(51) Int. Cl.
*G04B 15/14* (2006.01)
*G04B 15/06* (2006.01)

(52) U.S. Cl.
CPC ..... *G04B 15/06* (2013.01)
USPC ..... 368/127; 368/129

(58) Field of Classification Search
CPC ..... G04B 15/14; G04B 15/06; G04B 15/08; G04C 5/00
USPC ..... 368/127, 129–131, 124, 132
See application file for complete search history.

(56) References Cited

U.S. PATENT DOCUMENTS

| | | | | |
|---|---|---|---|---|
| 1,091,261 | A * | 3/1914 | Walker | 368/131 |
| 2,907,168 | A * | 10/1959 | Zen-Ichi Inotsume | 368/130 |
| 5,907,524 | A * | 5/1999 | Marmy et al. | 368/175 |
| 2008/0219103 | A1 | 9/2008 | Baumberger et al. | 368/131 |
| 2010/0006540 | A1 * | 1/2010 | Dinger et al. | 216/41 |
| 2010/0149926 | A1 * | 6/2010 | Colpo et al. | 368/127 |
| 2010/0214880 | A1 * | 8/2010 | Rappo et al. | 368/127 |
| 2010/0214881 | A1 * | 8/2010 | Chiuve et al. | 368/131 |
| 2010/0308010 | A1 * | 12/2010 | Cusin et al. | 216/19 |
| 2012/0063274 | A1 * | 3/2012 | Uchiyama et al. | 368/127 |

FOREIGN PATENT DOCUMENTS

JP 2005164599 6/2005

OTHER PUBLICATIONS

George Daniel, "The Practical Watch Escapement", Premier Print Limited, 1994 (First Edition), pp. 39-47.

* cited by examiner

*Primary Examiner* — Amy Cohen Johnson
*Assistant Examiner* — Matthew Powell
(74) *Attorney, Agent, or Firm* — Adams & Wilks

(57) ABSTRACT

A detent escapement for a timepiece includes an escape wheel, a balance having an unlocking jewel, and a blade. A rotation reference line is formed by a straight line passing through a rotation center of the blade in a state where the balance is at an oscillation center. In order to balance (1) a sum total of the effects on rotational movement of the balance caused by "impulse before dead point" and by "resistance after dead point", which together comprise the total effect causing the timepiece to advance, and (2) a sum total of the effects on rotational movement of the balance caused by "resistance before dead point" and by "impact after dead point", which together comprise the total effect causing the timepiece to slow, the unlocking jewel is aligned with the rotation reference line and positioned at a position facing towards a direction farthest from the escape wheel.

13 Claims, 34 Drawing Sheets

(a)

(b)

(a)

(b)

(a)

(b)

(a)

(b)

(a)

(b)

(a)

(b)

(a)

(b)

(a)

(b)

(c)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

DETENT ESCAPEMENT AND MECHANICAL TIMEPIECE

CROSS-REFERENCE TO RELATED APPLICATIONS

This application is a U.S. national stage application of International Application No. PCT/JP2010/064819 filed Aug. 31, 2010, claiming a priority date of Mar. 10, 2010, and published in a non-English language.

BACKGROUND OF THE INVENTION

1. Technical Field

The present invention relates to a detent escapement and to a timepiece into which the detent escapement is incorporated. Particularly, the present invention relates to a detent escapement which is configured so as to decrease escapement error and to a mechanical timepiece into which a detent escapement configured as above is incorporated.

2. Background Art

In the related art, a "detent escapement" (chronometer escapement) has been known as one type of an escapement of a mechanical timepiece. As a representative mechanism form of the detent escapement, conventionally, a spring detent escapement and a pivoted detent escapement have been widely known (for example, refer to NPL 1 below).

Referring to FIG. 20, the conventional spring detent escapement 800 includes an escape wheel and pinion 810, a balance 820, a detent lever 840, and a balance spring 830 which is configured by a plate spring. An impulse pin 812 is fixed to a large collar of the balance 820. A locking jewel 832 is fixed to the detent lever 840. An unlocking jewel 824 is fixed to the large collar 816. The impulse pin 812 and the unlocking jewel 824 are configured so as to be able to contact a tooth portion 112 of the escape wheel and pinion 110.

Referring to FIG. 21, the conventional pivoted detent escapement 900 includes an escape wheel and pinion 910, a balance 920, a detent lever 930, and a balance spring 940 which is configured by a spiral spring (swirling spring). An impulse pin 912 is fixed to a large collar of the balance 920. A locking jewel 932 is fixed to the detent lever 930. An unlocking jewel 924 is fixed to the large collar 916.

Unlike a crab toothed lever escapement which is widely used currently, as a characteristic common to the escapements of the types shown in FIGS. 20 and 21, since power is directly transmitted from the escape wheel and pinion to the balance, there is an advantage in that loss of power (transmission torque) in the escapement can be decreased.

In addition, the conventional detent escapement includes an escape wheel and pinion (1), a balance, a detent (11) which supports a stop pawl (21), and a restricting plate (5) which is fixed to the balance. The detent escapement includes a balance spring (12), the inner end of which is integrated into the detent (11) (for example, refer to PTL 1 below).

CITATION LIST

Patent Literature

[PTL 1] PCT Japanese Translation Patent Publication No. 2009-510425 (Pages 5 to 7 and FIG. 1)

Non Patent Literature

[NPL 1] Pages 39 to 47, "The Practical Watch Escapement", Premier Print Limited, 1994 (First Edition), written by George Daniel

SUMMARY OF INVENTION

Problem to be Solved by the Invention

In a mechanical timepiece, escapement error is one of the factors that disturb isochronism (timekeeping accuracy), and the same applies to the crab toothed lever escapement and the direct impulse type escapement represented by the detent escapements mentioned above. When the escapement transmits energy to the balance based on Airy's theorem, escapement error is generated by operating as impact or resistance with respect to free oscillation of the balance.

When the balance oscillates freely as a result of the spring force of a hairspring, the impact and the resistance due to the escapement can be classified into "impact before dead point", "resistance before dead point", "impact after dead point", and "resistance after dead point". Here, "dead point" means the "balance oscillation center" when the balance oscillates freely. That is, "oscillation center" means a position which is at the exact the center between a rotation position when the balance rotates to the utmost in a first direction (for example, clockwise direction: rotation to the right) and a rotation position when the balance rotates to the utmost in a second direction (for example, counterclockwise direction: rotation to the left) which is a direction opposite to the first direction.

"Resistance before dead point" means applying a force in a direction opposite to the advancing direction of the balance before the unlocking jewel of the balance passes through the dead point (oscillation center of balance). That is, "resistance before dead point" means that a tip of a single blade spring contacts the unlocking jewel of the balance and applies resistance to the balance before the unlocking jewel of the balance passes through the dead point (oscillation center of balance).

"Impact before dead point" means applying a force with respect to the advancing direction of the balance before the unlocking jewel of the balance passes through the dead point (oscillation center of balance). That is, "impact before dead point" means that the tooth portion of the escape wheel and pinion contacts the impulse pin of the balance and applies a force with respect to the advancing direction of the balance before the unlocking jewel of the balance passes through the dead point (oscillation center of balance).

"Impact after dead point" means applying a force in the advancing direction of the balance after the unlocking jewel of the balance passes through the dead point (oscillation center of balance). That is, "impact after dead point" means that the tooth portion of the escape wheel and pinion presses the impulse pin of the balance and applies a force in the advancing direction of the balance after the unlocking jewel of the balance passes through the dead point (oscillation center of balance).

"Resistance after dead point" means applying a force in the direction opposite to the advancing direction of the balance after the unlocking jewel of the balance passes through the dead point (oscillation center of balance). That is, "resistance after dead point" means that the tip of the single blade spring contacts the unlocking jewel of the balance and applies resistance to the balance after the unlocking jewel of the balance passes through the dead point (oscillation center of balance). Moreover, "resistance after dead point" means that a tip of a single blade spring contacts the unlocking jewel of the balance and applies resistance to the balance after the unlocking jewel of the balance passes through the dead point (oscillation center of balance), returns toward the dead point (oscillation center of balance), and the unlocking jewel of the balance passes through the dead point again (oscillation center of balance).

In general, when there is no disturbance, it is known that the oscillation period of the balance is constant due to "isochronism of the pendulum" regardless of the amplitude of the balance. On the other hand, when the balance is positioned at a position which is separated from the dead point (oscillation center), the influence that disturbance has on the oscillation period of the balance is great. Moreover, the impact that occurs when the balance passes through the dead point (oscillation center of balance) does not have an effect on the oscillation period of the balance. In addition, the resistance that occurs when the balance passes through the dead point (oscillation center of balance) does not influence the oscillation period of the balance.

Next, the "Airy's theorem" will be described. Referring to FIG. 22, when disturbance is not applied to the balance, the oscillation period of the balance is constant due to the "isochronisms of the pendulum" regardless of the amplitude of the balance. "Impact before dead point (impact before passing through the oscillation center)" shortens the oscillation period and shifts the timing rate (sec/day) of the timepiece to a plus direction (advance). Moreover, "resistance after dead point (resistance after passing through the oscillation center)" also shifts the timing rate (sec/day) of the timepiece to the plus direction (advance). On the other hand, "resistance before dead point (resistance before passing through the oscillation center)" shifts the timing rate (sec/day) of the timepiece to a minus direction (delay). In addition, "impact after dead point (impact after passing through the oscillation center)" shifts the timing rate (sec/day) of the timepiece to the minus direction (delay).

Moreover, the further away the position to which disturbance is applied is from the oscillation center of the balance, the greater the influence on the oscillation period of the balance due to disturbance. Moreover, when disturbance is applied to the oscillation center of the balance, disturbance does not influence the oscillation period of the balance. Moreover, escapement error changes depending on the oscillation angle of the balance (that is, the input torque to the balance). Basically, a transmission efficiency of the escapement is improved, an escapement mechanism which can transfer and receive kinetic energy in a range of a narrow oscillation angles in the vicinity of the oscillation center of the balance is provided, and therefore, basic performance such as the timing rate of the mechanical timepiece can be improved.

Therefore, suppressing the change of the timing rate that accompanies the change of the oscillation angle of the balance is a problem to be solved.

An object of the present invention is to provide a detent escapement which is configured so as to further decrease escapement error than the detent escapement in the related art.

Solution to Problem

In general, escapement error (static escapement error) is indicated by the following equation.

$$SEE = Rd - Rn$$

Here,

SEE: static escapement error (sec/day);

Rd: timing rate (sec/day) in constant oscillation angle (arbitrary constant torque) at the time of driving escapement;

Rn: timing rate (sec/day) in free oscillation of balance.

In the present invention, by correcting a oscillation center position of a balance, the total sum of the influence on the timing rate generated by "impact before dead point", the influence on the timing rate generated by "resistance before dead point", the influence on the timing rate generated by "impact after dead point", and the influence on the timing rate generated by "resistance after dead point" is configured so as to be smaller than the detent escapement of the related art. That is, by correcting the oscillation center position of the balance, the present invention is configured so as to suppress a change of a period in a case where the escapement operates in a period of a free damped oscillation of the balance.

For example, correction of the oscillation center position of the balance can be obtained by setting a corrected amount to be different to some extent through a simulation, preparing an approximate equation (linear approximate equation), and calculating the corrected amount (angle) of the oscillation center position of the balance. Alternatively, in the correction of the oscillation center position of the balance, by preparing a same size or enlarged model escapement device for testing and setting a corrected amount to be different to some extent, an appropriate corrected amount (angle) can be obtained from the test results. In this way, by performing correction of the oscillation center position of the balance, escapement error can be significantly decreased compared to the detent escapement of the related art. Moreover, in this way, by performing correction of the oscillation center position of the balance, an isochronism curve can be improved compared to the detent escapement of the related art.

In the present invention, in a detent escapement for a timepiece which includes an escape wheel and pinion, a balance having an impulse pin capable of contacting a tooth portion of the escape wheel and pinion and an unlocking jewel, and a blade having a locking jewel capable of contacting the tooth portion of the escape wheel and pinion, a tip of a single blade spring contacting the unlocking jewel of the balance and applying resistance to the balance before the unlocking jewel of the balance passes through the oscillation center is defined as "resistance before dead point", the tooth portion of the escape wheel and pinion contacting an impulse pin of the balance and applying force with respect to an advancing direction of the balance before the unlocking jewel of the balance passes through the oscillation center is defined as "impact before dead point", the tooth portion of the escape wheel and pinion pressing the impulse pin of the balance and applying force with respect to an advancing direction of the balance after the unlocking jewel of the balance passes through the oscillation center is defined as "impact after dead point", the tip of the single blade spring contacting the unlocking jewel of the balance and applying resistance to the balance after the unlocking jewel of the balance passes through the oscillation center, and the tip of the blade spring contacting the unlocking jewel of the balance and applying resistance to the balance after the unlocking jewel of the balance passes through the oscillation center, returns toward the oscillation center, and the unlocking jewel of the balance passes through the oscillation center are defined as "resistance after dead point", and a straight line which passes through the rotation center of the blade with the rotation center of the balance as a starting point in a state where the balance is positioned at the oscillation center is defined as a rotation reference line.

In the detent escapement of the present invention, the unlocking jewel at the oscillation center is positioned at a position toward a direction which is far from the escape wheel and pinion based on the rotation reference line so that the total sum of influences, which advance the timing rate of a timepiece, including the sum of the influence on the rotational movement of the balance which is generated by "impact before dead point" and the influence on the rotational movement of the balance which is generated by "resistance after dead point", and the total sum of influences, which delay the timing rate of the timepiece, including the sum of the influence on the rotational movement of the balance which is generated by "resistance before dead point" and the influence on the rotational movement of the balance which is generated by "impact after dead point" are balanced. According to this configuration, escapement error can be decreased compared to the conventional spring detent escapement. Moreover, according to this configuration, an isochronism curve can be improved compared to the detent escapement of the related art.

In the detent escapement of the present invention, it is preferable that the unlocking jewel be fixed between a position in which the unlocking jewel is rotated by 10° from the rotation reference line and a position in which the unlocking jewel is rotated by 50° from the rotation reference line toward the direction which is far from the escape wheel and pinion. According to this configuration, escapement error can be further decreased compared to the conventional spring detent escapement.

In addition, in the detent escapement of the present invention, it is more preferable that the unlocking jewel be fixed at a position in which the unlocking jewel is rotated by 20° to 30° from the rotation reference line toward the direction which is far from the escape wheel and pinion. According to this configuration, escapement error can be significantly decreased compared to the conventional spring detent escapement.

Moreover, in the present invention, in a mechanical timepiece which is configured so as to include a mainspring which configures a driving source of the mechanical timepiece, a front train wheel which is rotated by a turning force when the mainspring is rewound, and an escapement for controlling the rotation of the front train wheel, the escapement is configured of the detent escapement of the present invention.

In the mechanical timepiece of the present invention, it is preferable that the balance includes a hairspring, an outer end of the hairspring is fixed to a stud which is provided so as to be able to rotate with respect to a balance bridge, and the mechanical timepiece is configured so as be able to change the position of the unlocking jewel and the position of the impulse pin with respect to the rotation reference line by rotating the stud with respect to the balance bridge. Moreover, it is preferable that the mechanical timepiece of the present invention further includes range indicating means for indicating a range through which the stud can be rotated.

According to this configuration, a thin mechanical timepiece capable of being easily adjusted can be realized compared to the conventional spring detent escapement. Moreover, in the mechanical timepiece of the present invention, escapement error can be decreased compared to the detent escapement of the related art.

Advantageous Effects of Invention

Since the detent escapement of the present invention is configured so as to apply energy to the balance from the escape wheel and pinion in a range of a narrow oscillation angle in the vicinity of the position through which the balance passes the dead point (oscillation center), escapement error of the mechanical timepiece can be decreased compared to the conventional spring detent escapement. Moreover, in the detent escapement of the present invention, the isochronism curve can be improved compared to the detent escapement of the related art. In addition, in the mechanical timepiece of the present invention, escapement error can be decreased compared to the detent escapement of the related art.

DETAILED DESCRIPTION OF THE INVENTION

Hereinafter, embodiments of the present invention will be described with reference to the drawings. In general, a machine body including a driving portion of a timepiece is referred to as "a movement". A state where a dial and hands are mounted on the movement and inserted into a timepiece case to achieve a finished product is referred to as "complete". In both sides of a main plate which configures a substrate of the timepiece, a side on which a glass of the timepiece case is disposed, that is, a side on which the dial is disposed is referred to as a "back side" of the movement, a "glass side", or a "dial side". In both sides of the main plate, a side in which a case back of the timepiece case is disposed, that is, the side opposite to the dial is referred to as a "front side" of the movement or a "case back side". A train wheel which is incorporated into the "front side" of the movement is referred to as a "front train wheel". A train wheel which is incorporated into the "back side" of the movement is referred to as a "back wheel train".

(1) Configuration of Detent Escapement of the Present Invention

Figure 1:
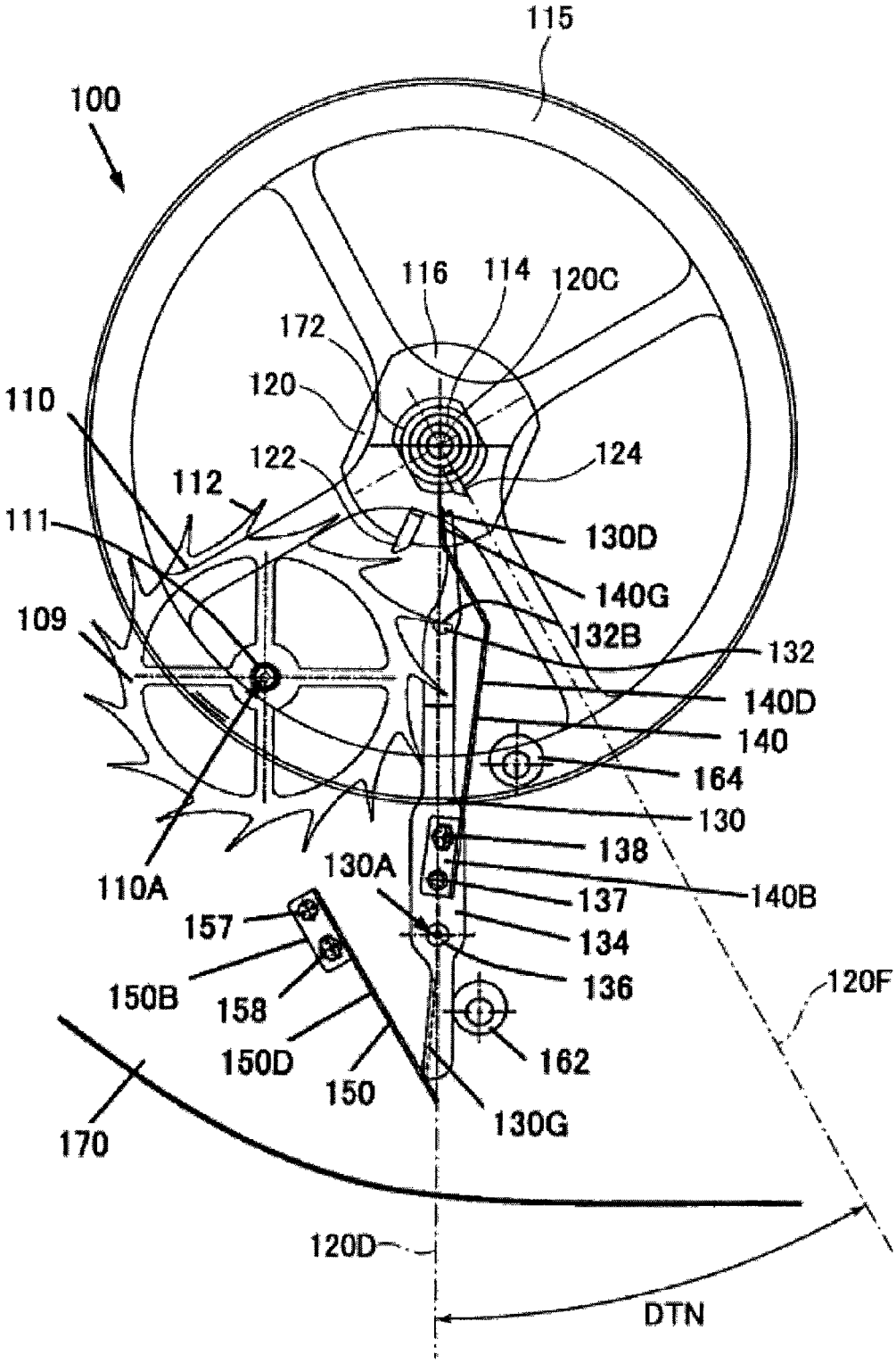
FIG. 1 is a plan view showing the structure of an escapement in an embodiment of a detent escapement of the present invention.
Figure 7:
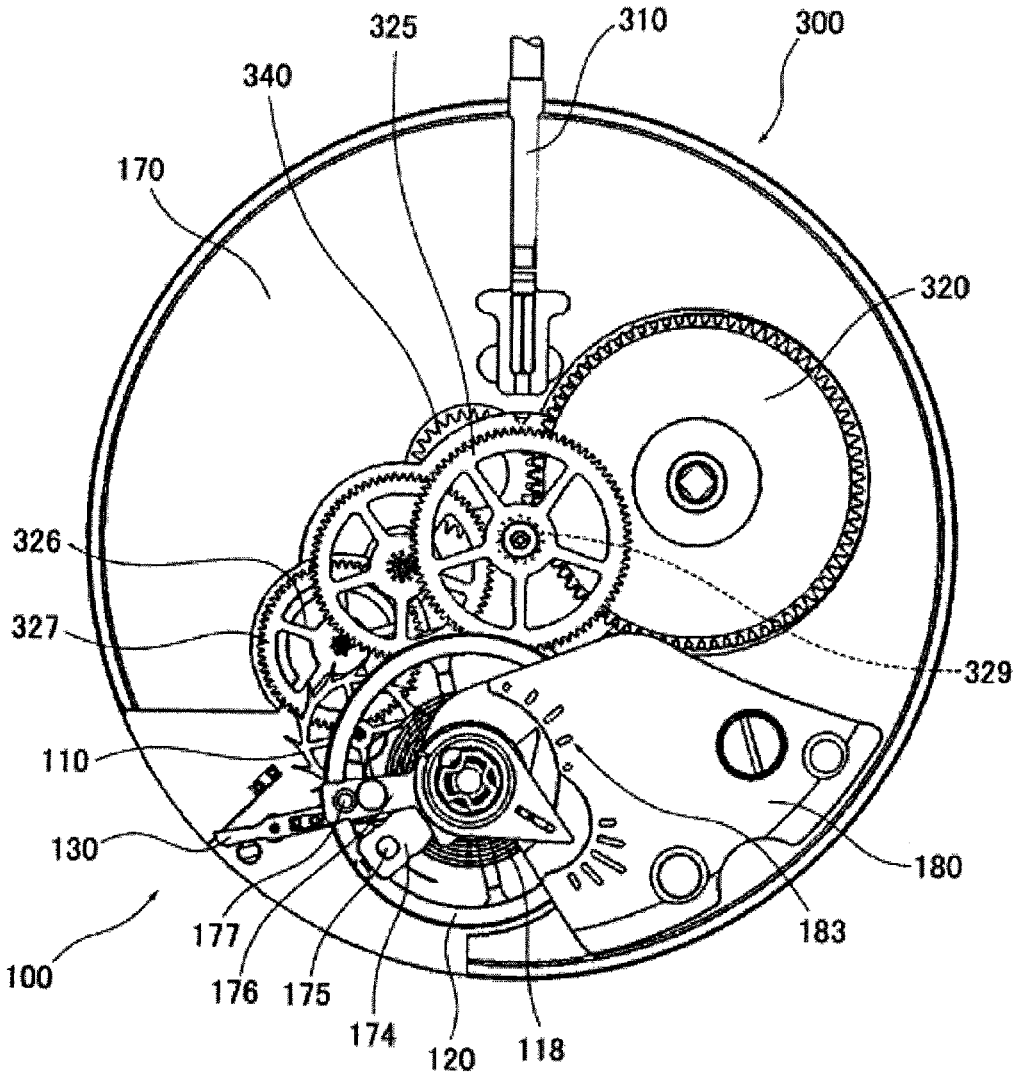
FIG. 7 is a plan view showing a structure such as a front train wheel and the escapement in an embodiment of a mechanical timepiece which uses the detent escapement of the present invention.
Figure 8:
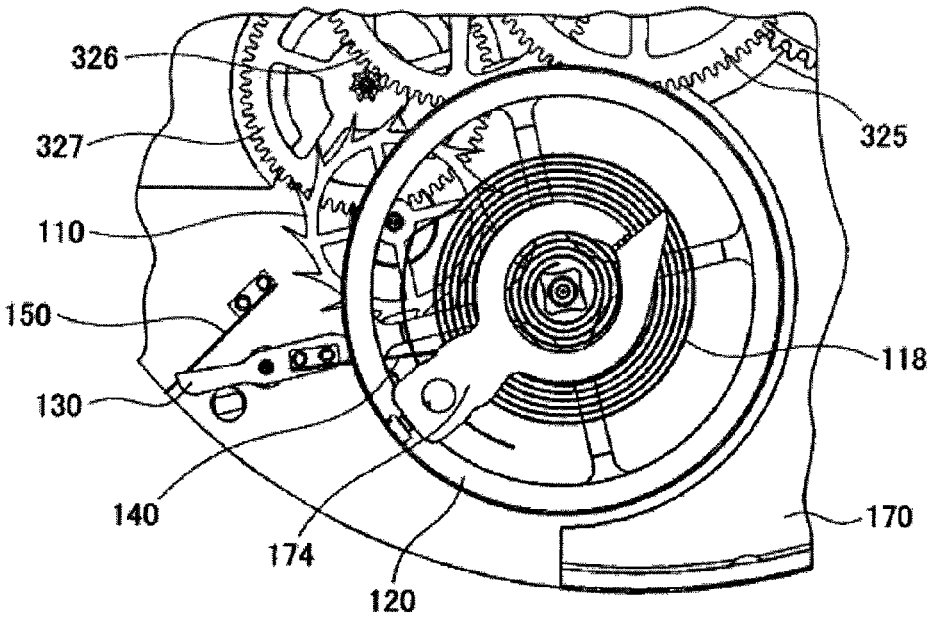
FIG. 8 is a plan view showing an escape wheel and pinion and a portion of a balance in the embodiment of the detent escapement of the present invention.
Figure 8:
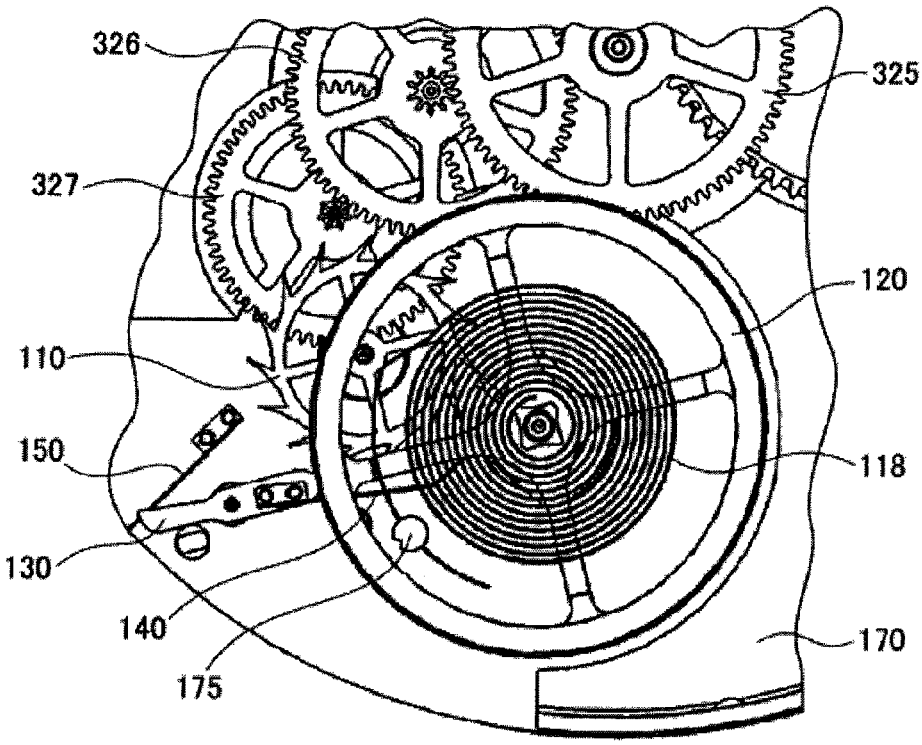

Referring to FIGS. 1, 7 and 8, a movement 300 of the timepiece may include a detent escapement 100 of the present invention. The detent escapement 100 of the present invention includes an escape wheel and pinion 110, a balance 120, and a blade 130 which has a locking jewel 132 including a contact plane 132B which is capable of contacting a tooth portion 112 of the escape wheel and pinion 110.

The balance 120 includes a balance staff 114, a wheel 115, a large collar 116, and a hairspring 118. The impulse pin 122 is fixed to the large collar 116. The balance 120 includes a balance staff 114, a wheel 115, a large collar 116, and a hairspring 118. An unlocking jewel 124 is fixed to the large collar 116. The impulse pin 122 and the unlocking jewel 124 are configured so as to be able to contact the tooth portion 112 of the escape wheel and pinion 110.

Figure 9:
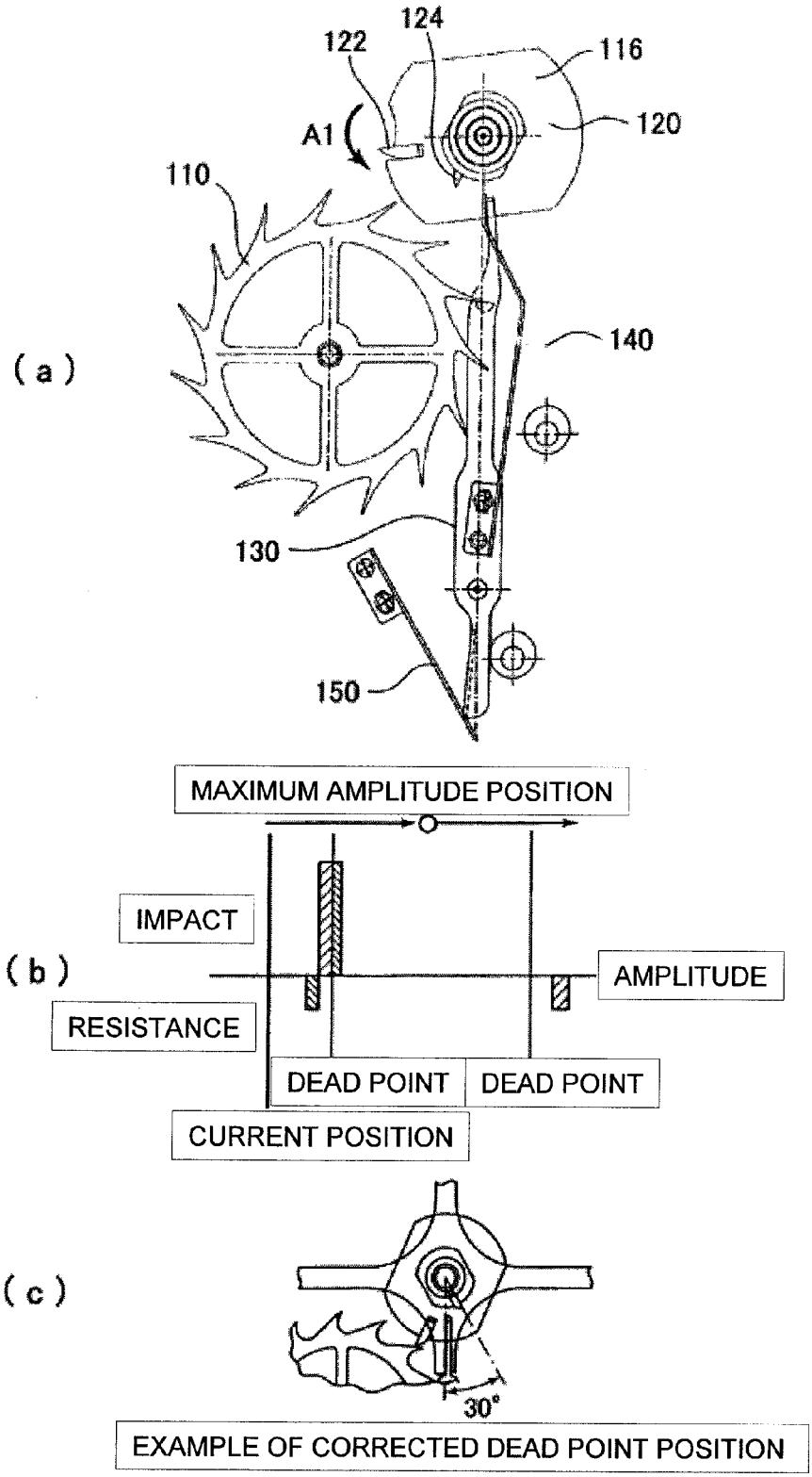
FIG. 9 is a (first) plan view showing an operating state of the escapement in the embodiment of the detent escapement of the present invention.

Referring to FIGS. 1 and 9(*c*), a straight line which passes through the rotation center 130A of the blade 130 with the rotation center 120C of the balance 120 as a starting point in a state where the balance 120 is positioned at a oscillation center is defined as a rotation reference line 120D. The unlocking jewel 124 is configured so as to be fixed at a position toward a direction which is far from (i.e., a direction away from) the escape wheel and pinion 110 based on the rotation reference line 120D so that the total sum of influences which advance the timing rate of the timepiece including the sum of the influence on the rotational movement of the balance 120 which is generated by "impact before dead point" and the influence on the rotational movement of the balance 120 which is generated by "resistance after dead point", and the sum of influences which delay the timing rate of the timepiece including the sum of the influence on the rotational movement of the balance 120 which is generated by "resistance before dead point" and the influence on the rotational movement of the balance 120 which is generated by "impact after dead point" are balanced to each other.

It is preferable that the unlocking jewel 124 be fixed between a position in which the unlocking jewel is rotated by 10° from the rotation reference line 120D and a position in which the unlocking jewel is rotated by 50° from the rotation reference line 120D toward the direction which is far from (i.e., a direction away from) the escape wheel and pinion 110. Moreover, it is more preferable that the unlocking jewel 124 be fixed at a position in which the unlocking jewel is rotated by 20° to 30° from the rotation reference line 120D toward the direction which is far from the escape wheel and pinion 110. That is, in FIG. 1, an angle DTN between a straight line 120F which connects the rotation center of the balance 120 and a contact surface of the unlocking jewel 124 to each other and the rotation reference line 120D is preferably 10° to 50°, and is more preferably 20° to 30°. On the other hand, in the detent escapement of the related art, the unlocking jewel 124 is fixed so as to be positioned on the rotation reference line (the angle DTN is 0°).

A single blade spring 140 capable of contacting the unlocking jewel 124 is provided on the blade 130. The single blade spring 140 may be configured of a plate spring of an elastic material such as a stainless steel. The single blade spring 140 includes a base portion 140B, a deforming spring portion 140D, and an unlocking jewel contacting portion 140G. It is preferable that the direction of the plate thickness of the deforming spring portion 140D of the single blade spring 140 be the direction perpendicular to the axial line 130A of the rotation center of the blade 130.

Referring to FIGS. 1, 7, 7A and 8, the escape wheel and pinion 110 includes an escape wheel 109 and an escape pinion 111. The tooth portion 112 is formed on the outer circumferential portion of the escape wheel 109. For example, as shown in FIG. 1, 15 numbers of the tooth portion 112 are formed on the outer circumferential portion of the escape wheel 109. The escape wheel and pinion 110 is incorporated into the movement so as to rotate with respect to the main plate 170 and a train wheel bridge (not shown). An upper shaft portion of the escape pinion 111 is supported so as to rotate with respect to the train wheel bridge (not shown). A lower shaft portion of the escape pinion 111 is supported so as to rotate with respect to the main plate 170.

The balance 120 is incorporated into the movement so as to rotate with respect to the main plate 170 and a balance bridge 180. An upper shaft portion of the balance staff 114 is supported so as to rotate with respect to the balance bridge 180. A lower shaft portion of the balance staff 114 is supported so as to rotate with respect to the main plate 170. An inner end of the hairspring 118 is fixed to a collet 172 which is fixed to the balance staff 114. An outer end of the hairspring 118 is fixed to a stud 175 which is fixed to a stud support 174. The stud support 174 is supported so as to rotate by only a predetermined angle with respect to the balance bridge 180. The stud support 174 and the stud 175 are integrally rotated to each other, and thereby, the stud is rotated with respect to the balance bridge of the unlocking jewel 124 based on the rotation reference line 120D. Therefore, the position of the unlocking jewel and the position of the impulse pin 122 can be changed with respect to the rotation reference line. That is, according to this configuration, the position of the unlocking jewel 124 with respect to the position of the oscillation center of the balance 120 is adjusted, and a correction of the position of the oscillation center of the balance 120 can be performed by adjusting the position of the impulse pin 122.

Moreover, it is preferable that rotatable range indicating means for indicating a range in which the movable stud support 175 can be rotated be provided. For example, the rotatable range indicating means may be configured by a marking 183 which is provided on the balance bridge 180. The marking 183 may be formed at a plurality of positions. For example, as shown in FIG. 7, the marking 183 may be configured so as to include a short carved seal of a delay side, a round carved seal having an intermediate length of the delay side, a long carved seal indicating a reference, a round carved seal having an intermediate length of an advance side, and a short carved seal of the advance side. The markings 183 may be provided on the balance bridge 180 or may be provided on other parts such as the train wheel bridge or the barrel bridge. The markings 183 may be a carved seal or a printing and may be configured by a contour shape such as the balance bridge 180 or the train wheel bridge, or a carved shape.

A regulator 176 for adjusting the timing rate of the timepiece is supported so as to be rotated by only a predetermined angle with respect to the balance bridge 180. A regulator pin 177 which is fixed to the regulator 176 contacts the vicinity of the outer end of the hairspring 118. The position at which the regulator pin 177 contacts the hairspring 118 is changed by rotating the regulator 176, and therefore, the timing rate of the timepiece can be adjusted.

The blade 130 is incorporated into the movement so as to rotate with respect to the main plate 170 and the train wheel bridge (not shown). The blade 130 includes a blade body 134 and a blade shaft 136. An upper shaft portion of the blade shaft 136 is supported so as to rotate with respect the train wheel bridge (not shown). A lower shaft portion of the blade shaft 136 is supported so as to rotate with respect to the main plate 170. Alternatively, the blade 130 may be incorporated into the movement 300 so as to rotate with respect to the main plate 170 and a blade bridge (not shown). In this configuration, the upper shaft portion of the blade shaft 136 is supported so as to rotate with respect to a blade bridge (not shown). A spring bearing protrusion 130D is provided on the tip of the blade 130 near to the balance 120. An unlocking jewel contacting portion 140G of the single blade spring 140 is disposed so as to contact the spring bearing protrusion 130D.

The blade 130 is configured so as to rotate in two directions of a direction in which the locking jewel 132 approaches the escape wheel and pinion 110 and a direction in which the locking jewel 132 is far from the escape wheel and pinion 110. A balance spring 150 for applying a force, which rotates the blade 130 in the direction in which the locking jewel 132 approaches the escape wheel and pinion 110, to the blade 130 is provided. The balance spring 150 may be configured of a plate spring of an elastic material such as a stainless steel. The balance spring 150 includes a base portion 150B and a deforming spring portion 150D. It is preferable that a direction of the plate thickness of the deforming spring portion 150D of the balance spring 150 be a direction perpendicular to the axial line 130A of the rotation center of the blade 130.

The balance spring 150 is configured so as to apply a force to the blade 130 within a plane perpendicular with respect to the axial line 110A of the rotation center of the escape wheel and pinion 110. The single blade spring 140 and the balance spring 150 are disposed in a position in a direction which is symmetrical with respect to the rotation center 130A of the blade 130. The direction in which the balance spring 150 applies a force to the blade 130 is configured so as to rotate in a direction in which a portion of the blade 130, on which the locking jewel 132 is provided, approaches the escape wheel and pinion 110.

According to this configuration, since the balance spring 150 always applies a force to the blade 130, the blade 130 can directly return to the initial position shown in FIG. 1. Moreover, the detent escapement of the present invention is configured so that the balance spring 150 applies the force returning the blade to the initial position, which corresponds to "pulling" operation in the crab toothed lever escapement, to blade 130. Therefore, the detent escapement of the present invention includes characteristics which are not easily subjected to the influence of disturbance compared to the conventional spring detent escapement.

It is preferable that the detent escapement 100 of the present invention be configured so that the single blade spring 140 and the balance spring 150 includes a portion which is positioned within one plane perpendicular to the axial line 110A of the rotation center of the escape wheel and pinion 110. According to this configuration, a thin detent escapement can be realized compared to the conventional spring detent escapement.

Figure 2:
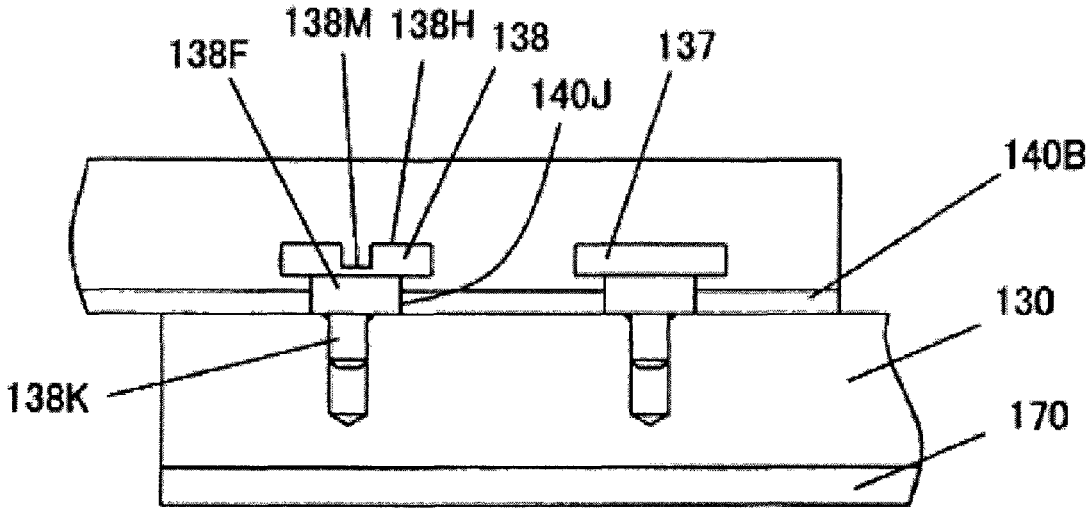
FIG. 2 is a cross-sectional view showing a fixing pin of a single blade spring and an eccentric pin of the single blade spring in the embodiment of the detent escapement of the present invention.

Referring to FIGS. 1 and 2, the single blade spring 140 is fixed to the blade body 134 by the fixing pin 137 of the single blade spring. The eccentric pin 138 of the single blade spring for adjusting the position of the tip of the single blade spring 140 is fixed to the blade body 134. The eccentric pin 138 of the single blade spring includes an eccentric shaft portion 138F, a head portion 138H, and a fixing portion 138K. The fixing portion 138K is inserted so as to rotate to a fixing hole of the main plate 170. For example, eccentric amount of the eccentric shaft portion 138F can be set to about 0.1 mm to 2 mm. A driver groove 138M is provided on the head portion 138H. The eccentric shaft portion 138F of the eccentric pin 138 of the single blade spring is disposed in a window portion 140J of the single blade spring 140. By rotating the eccentric shaft portion 138F of the eccentric pin 138 of the single blade spring, the single blade spring 140 can rotate along the upper surface of the blade body 134 with respect to the center axial line of the fixing pin 137 of the single blade spring as the rotation center.

Figure 4:
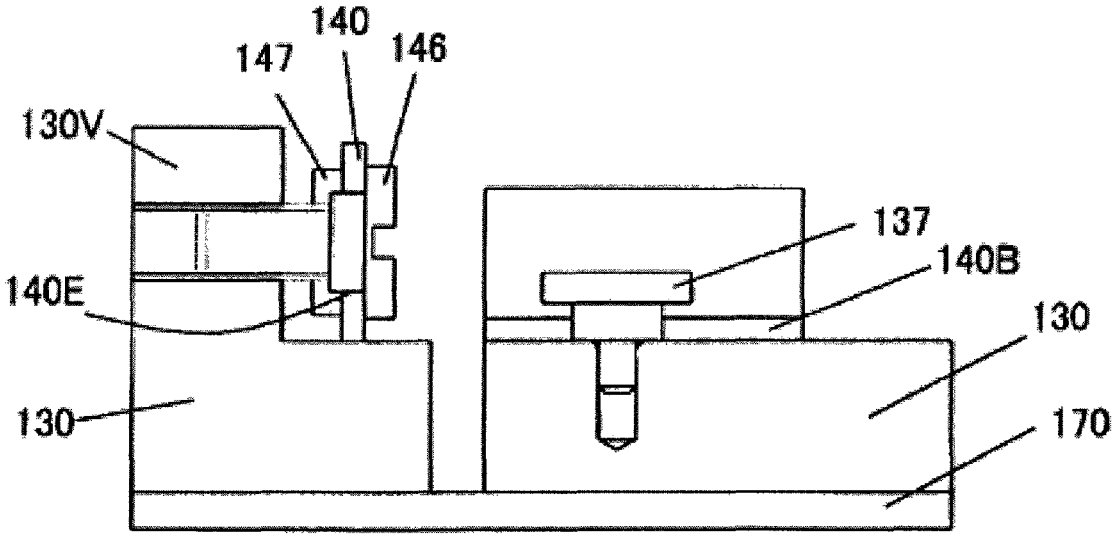
FIG. 4 is a cross-sectional view showing the fixing pin of the balance spring and a horizontal screw of the balance spring in the embodiment of the detent escapement of the present invention.

As a modification, referring to FIG. 4, a horizontal screw 146 of the single blade spring for adjusting the position of the tip of the single blade spring 140 may be provided. A supporting hole portion 140E of the single blade spring 140 is supported between the horizontal screw 146 of the single blade spring and a supporting nut 147 of the single blade spring. A screw portion of the horizontal screw 146 of the single blade spring is configured so as to be screwed into a female screw portion which is provided on a vertical wall portion 130V of the blade 130. According to this configuration, adjusting the force which applies the single blade spring 140 to the tip of the blade 130 can be easily performed.

Figure 3:
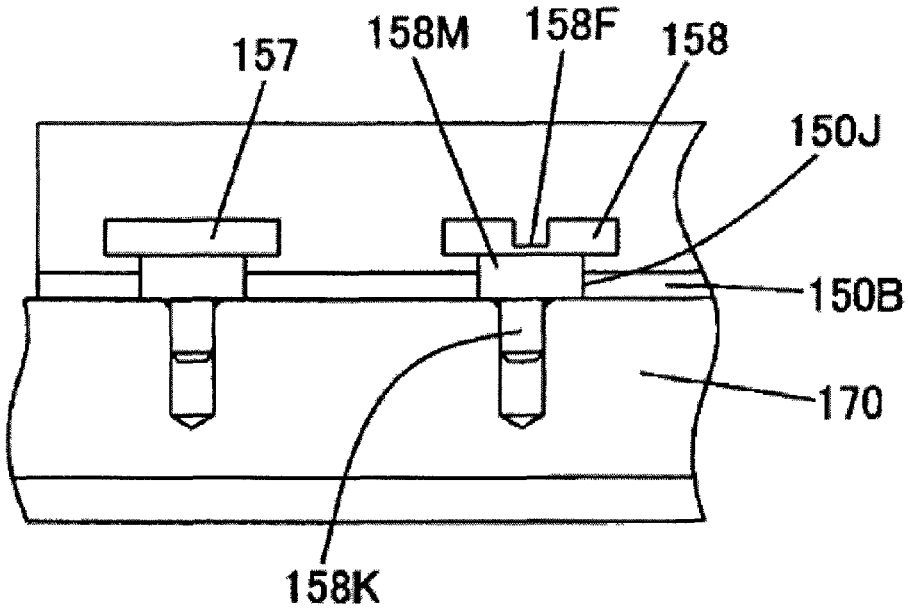
FIG. 3 is a cross-sectional view showing a fixing pin of a balance spring and an eccentric pin of the balance spring in the embodiment of the detent escapement of the present invention.

Referring to FIGS. 1 and 3, the balance spring 150 is fixed to the main plate 170 by a fixing pin 157 of the balance spring. An eccentric pin 158 of the balance spring for adjusting the position of the tip of the balance spring 150 is fixed to the main plate 170 (that is, substrate). The eccentric pin 158 of the balance spring includes an eccentric shaft portion 158F, a head portion 158H, and a fixing portion 158K. The fixing portion 158*k* is inserted and fixed to a fixing hole of the main plate 170. For example, the eccentric amount of the eccentric shaft portion 158F may be set to about 0.1 mm to 2 mm. A driver groove 158M is provided on the head portion 158H. The eccentric shaft portion 158F of the eccentric pin 158 of the balance spring is disposed in a window portion 150J of the balance spring 150. By rotating the eccentric shaft portion 158F of the eccentric pin 158 of the balance spring, the balance spring 150 can rotate along the upper surface of the main plate 170 with the center axial line of the fixing pin 157 of the balance spring as the rotation center.

As a modification, the balance spring 150 may be configured so as to be fixed with respect to the main plate 170 (that is, substrate) using a fixing horizontal screw (not shown) of the balance spring. The fixing horizontal screw of the balance spring may be configured so as to be similar to the structure of the horizontal screw 146 of the single blade spring shown in FIG. 4. According to this configuration, magnitude of the force applied to the blade 130 can be easily adjusted. Moreover, according to this configuration, since the resistance added to the balance 120 can be controlled, a control of an oscillation angle of the balance 120 can be performed.

Figure 5:
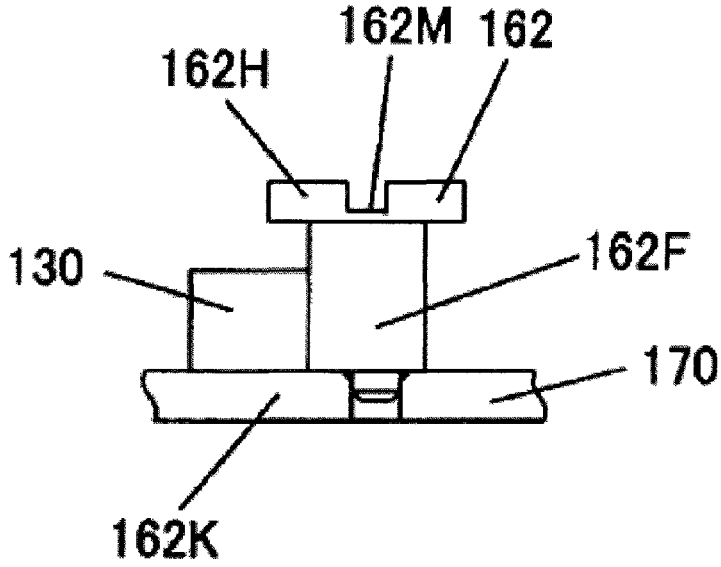
FIG. 5 is a cross-sectional view showing an adjusting eccentric pin in the embodiment of the detent escapement of the present invention.
Figure 6:
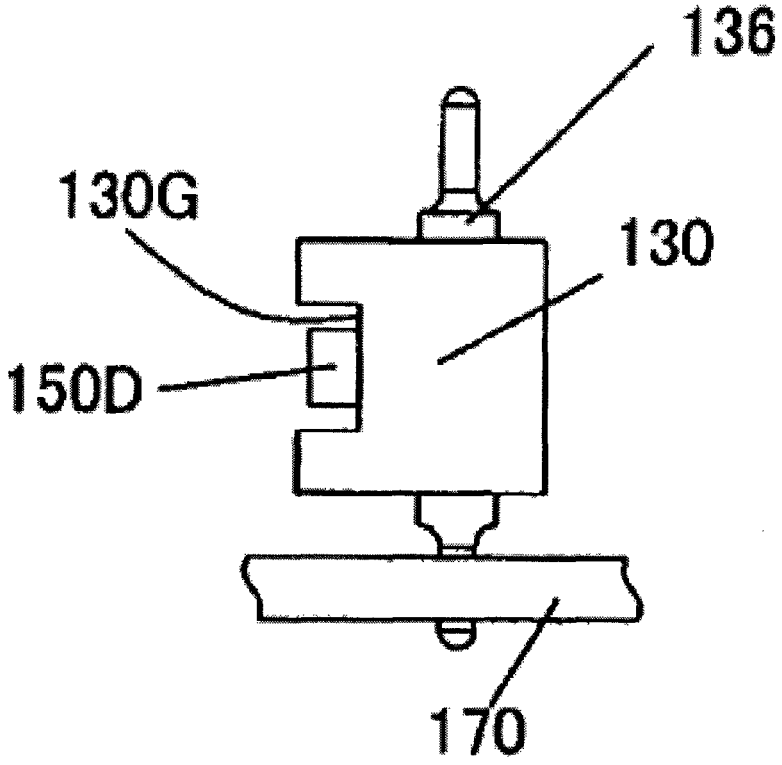
FIG. 6 is a partial cross-sectional view showing a receiving concave portion for receiving the balance spring in the embodiment of the detent escapement of the present invention.

Referring to FIGS. 1 and 5, an adjusting eccentric pin 162 for adjusting the initial position of the blade 130 is provided so as to rotate at the main plate 170 (that is, substrate). The adjusting eccentric pin 162 includes an eccentric shaft portion 162F, a head portion 162H, and a fixing portion 162K. The fixing portion 162K is inserted so as to rotate to the fixing hole of the main plate 170. For example, the eccentric amount of the eccentric shaft portion 162F may be set to about 0.1 mm to 2 mm. The driver groove 158M is provided on the head portion 162H. The eccentric shaft portion 162F of the adjusting eccentric pin 162 is disposed so as to contact the side surface portions of the blade 130. By rotating the eccentric shaft portion 162F of the adjusting eccentric pin 162, the initial position of the blade 130 can be easily adjusted.

Referring to FIG. 1, a slip-off preventing eccentric pin 164 for preventing slip-off of the blade 130 is provided on the main plate 170 (that is, substrate). The slip-off preventing eccentric pin 164 may be configured so as to be similar to the structure of the adjusting eccentric pin 162 shown in FIG. 5. For example, the eccentric amount of the eccentric shaft portion of the slip-off preventing eccentric pin 164 may be set to about 0.1 mm to 2 mm. According to this configuration, even when the blade greatly moves parallel to the substrate surface by disturbance, the slip-off of the balance spring from the blade can be effectively prevented. By rotating the eccentric shaft portion of the slip-off preventing eccentric pin 164, the movement range of the blade 130 can be easily adjusted.

Referring to FIGS. 1 and 2-6, a receiving concave portion 130G for receiving the balance spring 150 is provided on the side surface of the blade 130. A blade contacting portion of the balance spring 150 is received into the receiving concave portion 130G. According to this configuration, even though the balance spring 150 greatly moves in up and down directions from the surface of the main plate 170 (that is, substrate), the slip-off of the balance spring 150 from the blade 130 can be effectively prevented.

Referring to FIG. 1, due to the fact that the slip-off preventing eccentric pin 164 is provided, even though the blade 130 greatly moves parallel to the surface of the main plate 170 by disturbance, the slip-off of the balance spring 150 from the blade 130 can be effectively prevented.

(2) Operation of Detent Escapement of the Present Invention

Next, referring to FIGS. 9 to 15, an operation of the detent escapement of the present invention will be described. In FIGS. 9 to 15, (a) in the drawings is a plan view showing the operating state of the detent escapement, and (b) in the drawings is a view showing the impact (torque) and the resistance (torque) due to four escapements, that is, the influence on the advance of the timing rate and the influence on the delay of the timing rate due to "impact before dead point", "resistance before dead point", "impact after dead point", and "resistance after dead point". FIG. 9(*c*) is a partial plan view showing a configuration in which the unlocking jewel 124 is fixed at the position toward the direction which is far from the escape wheel and pinion 110 based on the rotation reference line 120D. In FIGS. 9(*b*) to 15(*b*), the horizontal axis indicates a rotation angle of the balance 120 and the vertical axis indicates the impact (torque) and the resistance (torque) which are applied to the balance 120. Here, the influence on the advance of the timing rate is shown by hatchings diagonally rising to the right, and the influence on the delay of the timing rate is shown by hatchings diagonally lowering to the right. Moreover, in FIGS. 9(*b*) to 15(*b*), the "dead point" of the oscillation of the balance 120 (oscillation center of the balance) is shown by a vertical line (solid line). In FIGS. 9(*b*) to 15(*b*), a maximum amplitude position of the balance 120 is shown by a white circle. In FIGS. 9(*b*) to 15(*b*), a current position of the balance 120 is shown by a vertical line (thick solid line).

(2-1) First Operation

Referring to FIG. 9(*a*), the balance 120 performs a free oscillation, and therefore, the large collar 116 rotates in a direction of an arrow A1 (counterclockwise direction). Referring to FIG. 9(*b*), the balance 120 rotates in a counterclockwise direction toward the dead point (oscillation center) from the position shown in FIG. 9(*a*).

(2-2) Second Operation

Figure 10:
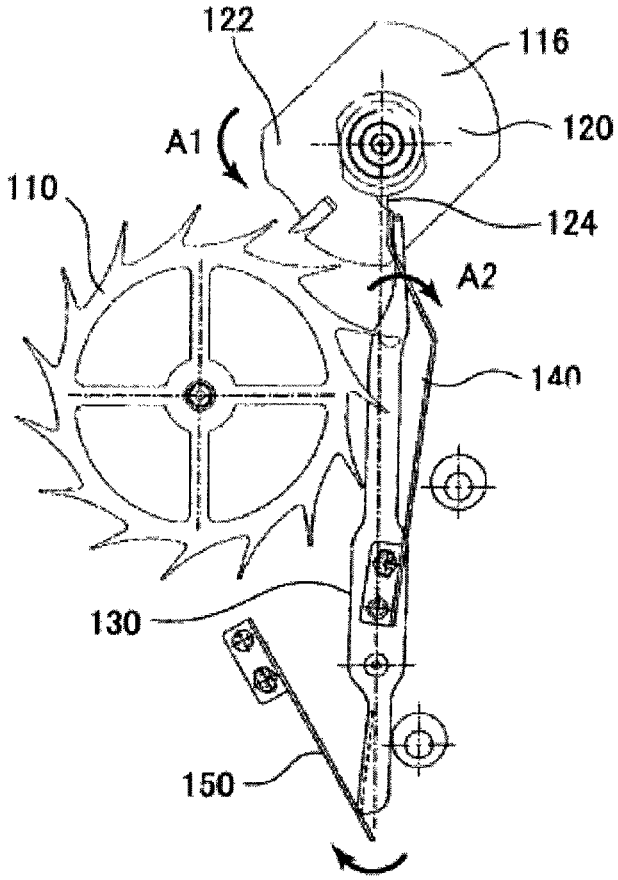
FIG. 10 is a (second) plan view showing an operating state of the escapement in the embodiment of the detent escapement of the present invention.
Figure 10:
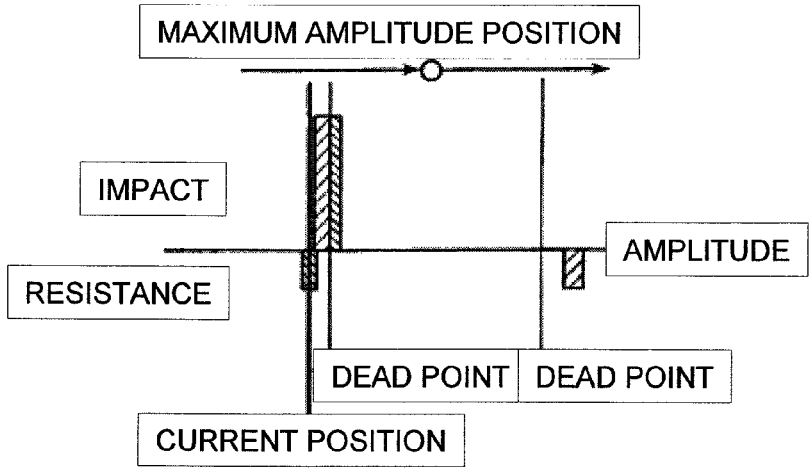

Referring to FIG. 10(*a*), the unlocking jewel 124 which is fixed to the large collar 116 rotates in the direction of the arrow A1 (counterclockwise direction) and the unlocking jewel contacts the unlocking jewel contacting portion 140G of the single blade spring 140. Subsequently, the unlocking jewel 124 rotates in the direction of the arrow A1 (counterclockwise direction), the single blade spring 140 is pressed to the unlocking jewel 124, and the single blade spring presses the spring bearing protrusion 130D. Thereby, the blade 130 rotates in a direction of an arrow A2 (clockwise direction). The tip of the tooth portion 112 of the escape wheel and pinion 110 slides on the contact plane 132B of the locking jewel 132. According to the operation in which the blade 130 rotates in the direction of the arrow A2 (clockwise direction), the blade body 134 is separated from the adjusting eccentric pin 162. Referring to FIG. 10(*b*), the balance 120 receives "resistance before dead point", and therefore, receives the influence in which the timing rate is delayed. The value of the influence in which the timing rate is delayed in the state shown in FIG. 10(*a*) is smaller than the value of the influence in which the timing rate is delayed due to "impact after dead point" in a state shown in FIG. 11(*a*) which is generated after the state of FIG. 10(*a*).

(2-3) Third Operation

Figure 11:
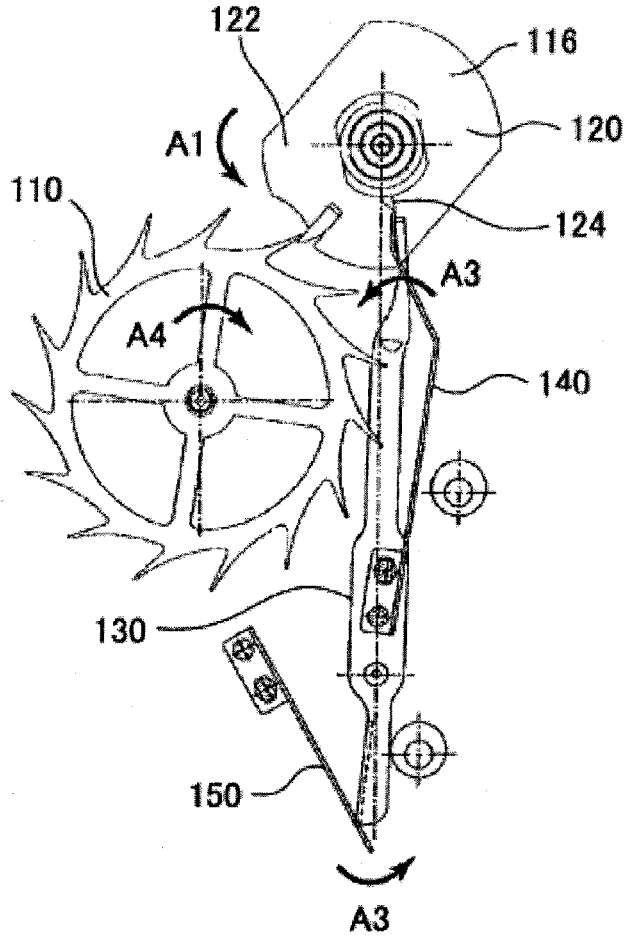
FIG. 11 is a (third) plan view showing an operating state of the escapement in the embodiment of the detent escapement of the present invention.
Figure 11:
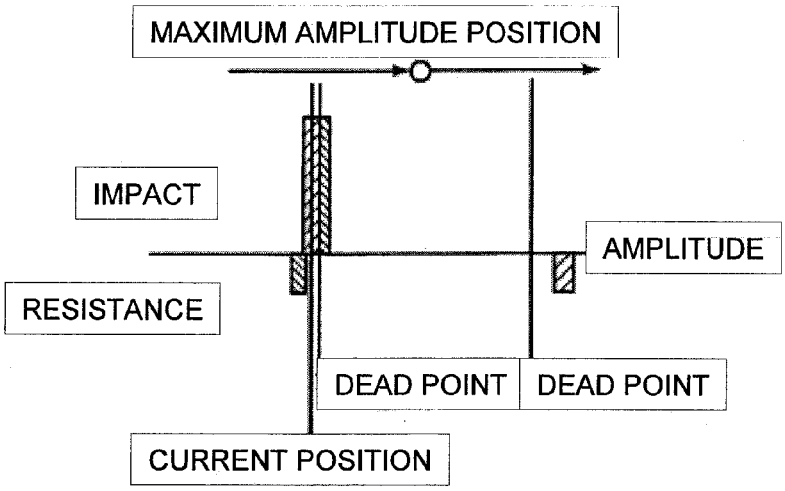

Referring to FIG. 11(*a*), the tip of the tooth portion 112 of the escape wheel and pinion 110 contacts the contact plane 132B of the locking jewel 132. The escape wheel and pinion 110 is rotated by the front train wheel which is rotated by the turning force when a mainspring is rewound and the escape wheel and pinion 110 is driven. The escape wheel and pinion 110 rotates in a direction of an arrow A4 (clockwise direction), the tip of the tooth portion 112 of the escape wheel and pinion 110 contacts the impulse pin 122, and the turning force is transmitted to the balance 120. If the large collar 116 rotates up to a predetermined angle in the direction of the arrow A1 (counterclockwise direction), the unlocking jewel 124 is separated from the unlocking jewel contacting portion 140G of the single blade spring 140. The blade 130 is rotated in the direction of the arrow A3 (counterclockwise direction) by the spring force of the balance spring 150 and returns to the original position. The tip of the tooth portion 112 of the escape wheel and pinion 110, which contacts the contact plane 132B of the locking jewel 132, is slipped-off from the locking jewel 132 (the escape wheel and pinion 110 is released). The blade 130 is rotated in the direction of the arrow A3 (counterclockwise direction) by the spring force of the balance spring 150 and the blade body 134 is pushed back toward the adjusting eccentric pin 162. The balance 120 receives "impact before dead point" and therefore, receives the influence in which the timing rate is advanced. The value of the influence in which the timing rate is advanced in the state shown in FIG. 11(*a*) is greater than the value of the influence in which the timing rate is delayed due to "impact after dead point" in the state shown in FIG. 10(*a*).

(2-4) Fourth Operation

Figure 12:
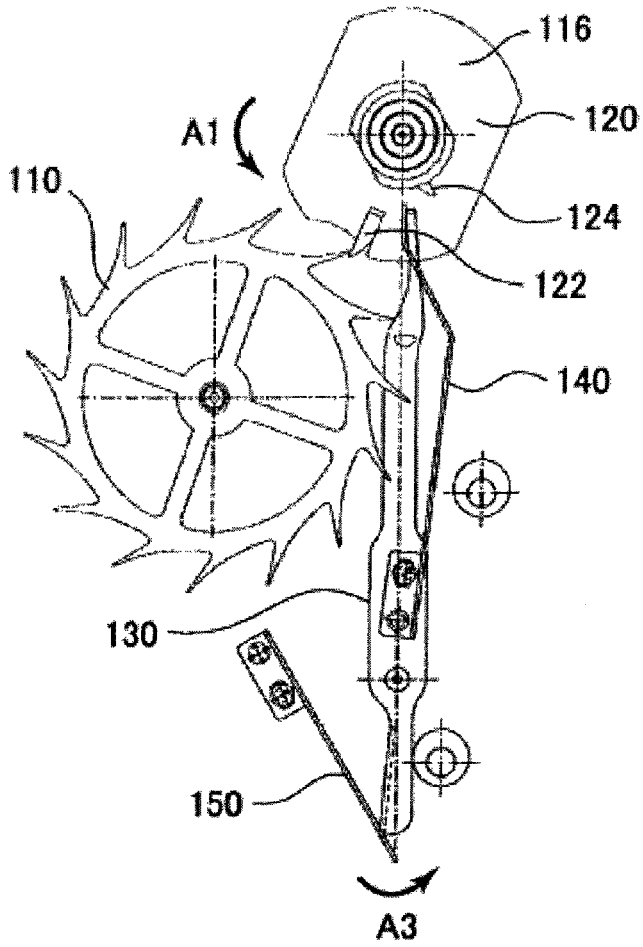
FIG. 12 is a (fourth) plan view showing an operating state of the escapement in the embodiment of the detent escapement of the present invention.
Figure 12:
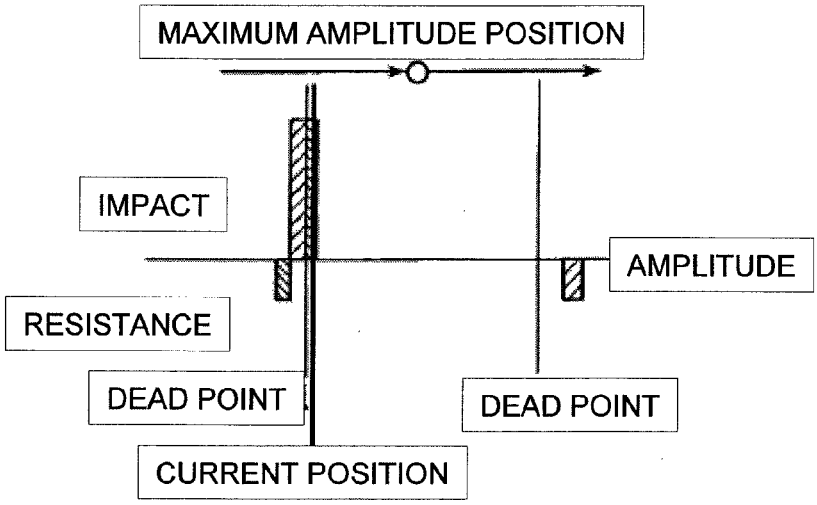

Referring to FIG. 12(*a*), continuously, the tip of the tooth portion 112 of the escape wheel and pinion 110 contacts the impulse pin 122, the turning force is transmitted to the balance 120, and the balance 120 passes through the dead point (oscillation center) and rotates. The blade body 134 of the blade 130 contacts the adjusting eccentric pin 162 by the spring force of the balance spring 150. The balance 120 receives "impact after dead point", and therefore, receives the influence in which the timing rate is delayed. The value of the influence in which the timing rate is delayed in the state shown in FIG. 12(*a*) is balanced with the value of the influence in which the timing rate is advanced due to "impact after dead point" in the above-described state shown in FIG. 11(*a*).

(2-5) Fifth Operation

Figure 13:
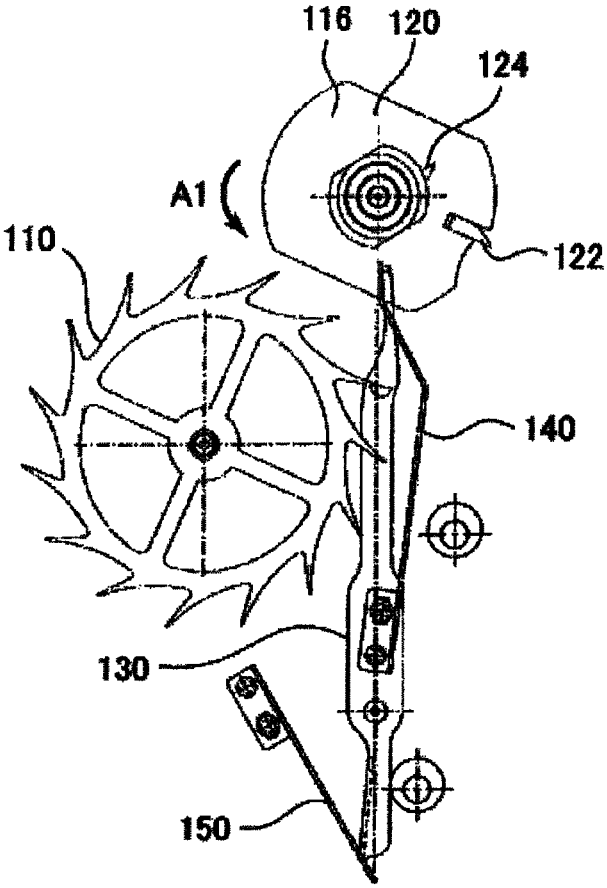
FIG. 13 is a (fifth) plan view showing an operating state of the escapement in the embodiment of the detent escapement of the present invention.
Figure 13:
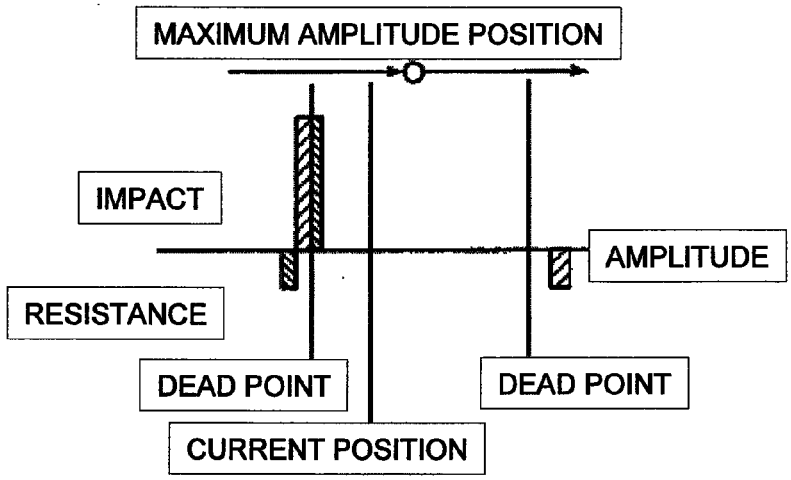

Referring to FIG. 13(*a*), the balance 120 performs a free oscillation in the direction of the arrow A1 (counterclockwise direction), and therefore, the tip of the next tooth portion 112 of the escape wheel and pinion 110 falls to the contact plane 132B of the locking jewel 132. Referring to FIG. 13(*b*), the balance 120 further oscillates freely, and therefore, the balance 120 crosses over the maximum amplitude position of the balance 120. Thereby, the large collar 116 rotates in a direction (clockwise direction) opposite to the direction of the arrow A1.

(2-6) Sixth Operation

Figure 14:
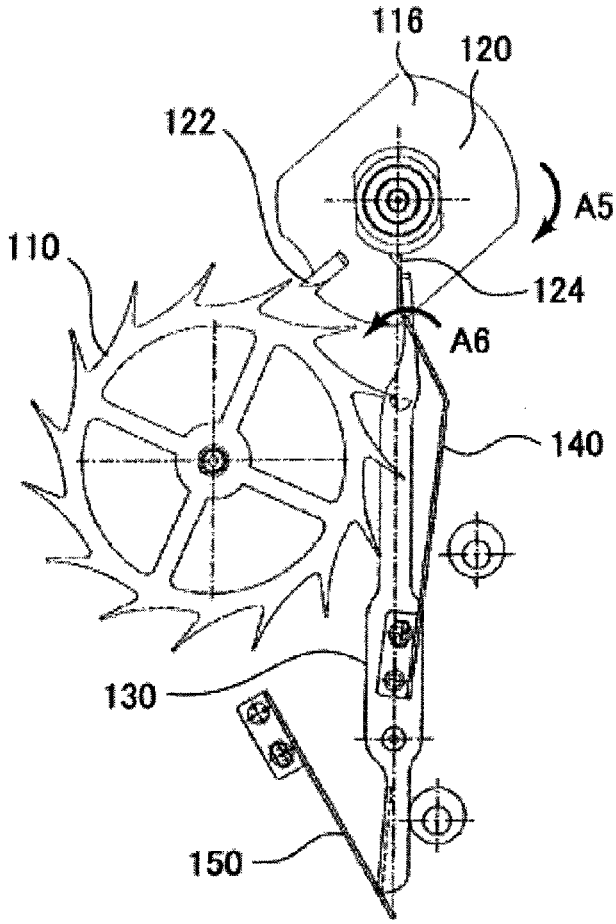
FIG. 14 is a (sixth) plan view showing an operating state of the escapement in the embodiment of the detent escapement of the present invention.
Figure 14:
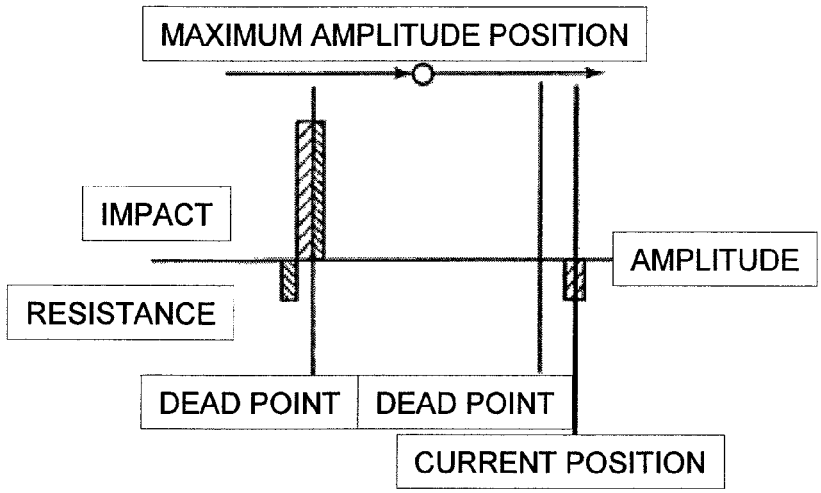

Referring to FIG. 14(*a*), the unlocking jewel 124 fixed to the large collar 116 rotates in a direction of an arrow A5 (clockwise direction) and contacts the unlocking jewel contacting portion 140G of the single blade spring 140. The unlocking jewel 124 rotates in the direction of the arrow A5 (clockwise direction) and the single blade spring 140 is pressed to the unlocking jewel 124. At this time, the blade spring 140 is separated from the spring bearing protrusion 130D of the blade 130. Therefore, only the single blade spring 140 is pushed to a direction of an arrow A6 (counterclockwise direction) by the unlocking jewel 124 in a state where the blade 130 is stationary. Referring to FIG. 14(*b*), the balance 120 receives "resistance after dead point", and therefore, receives the influence in which the time rate is advanced. The value of the influence in which the timing rate is advanced in the state shown in FIG. 14(*a*) is balanced with the value of the influence in which the timing rate is delayed due to "impact after dead point" in the above-described state shown in FIG. 10(*a*).

(2-7) Seventh Operation

Figure 15:
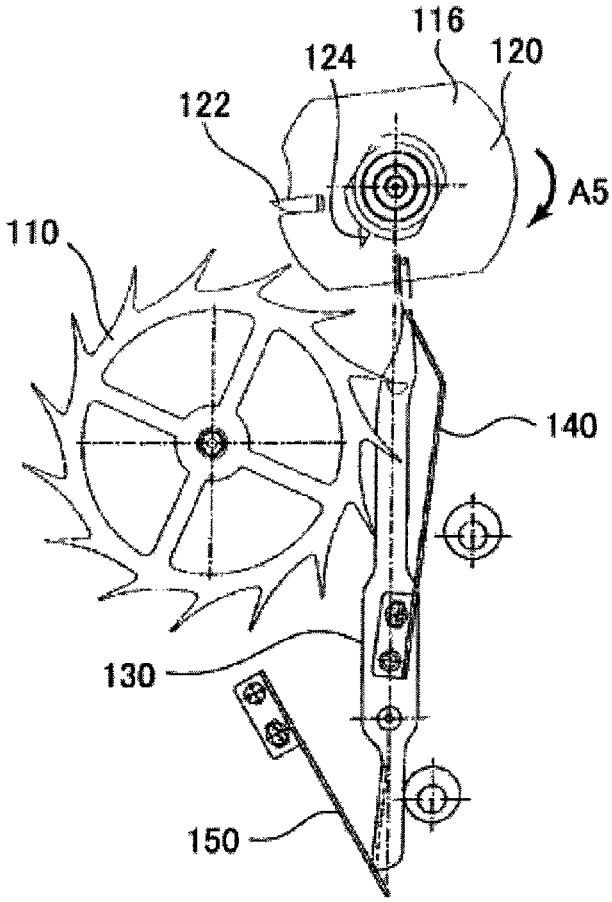
FIG. 15 is a (seventh) plan view showing an operating state of the escapement in the embodiment of the detent escapement of the present invention.
Figure 15:
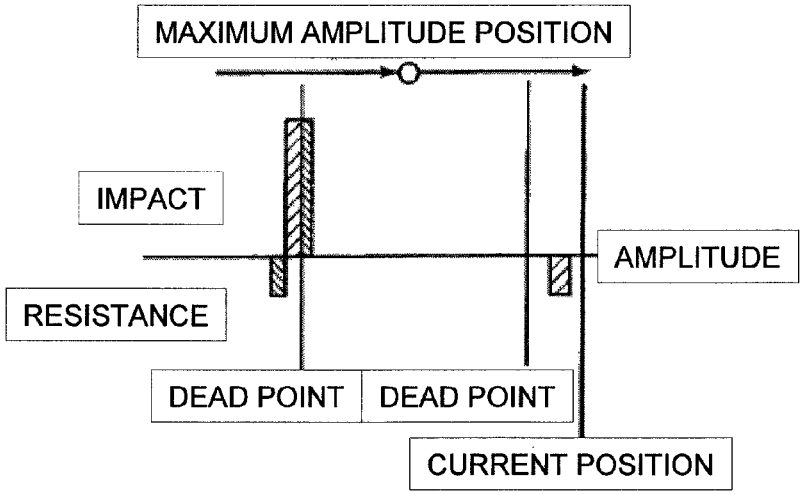

Referring to FIG. 15(*a*), if the large collar 116 rotates up to a predetermined angle in the direction of the arrow A5 (clockwise direction), the unlocking jewel 124 is separated from the unlocking jewel contacting portion 140G of the single blade spring 140. Thereby, the single blade spring 140 returns to the original position and the balance 120 performs a free oscillation. Referring to FIG. 15(*b*), the balance 120 further performs a free oscillation, and therefore, the balance 120 rotates toward the next maximum amplitude position.

(2-8) Repeat of Operation

Hereinafter, similarly, the operations from the state shown in FIG. 9 to the state shown in FIG. 15 can be repeated. As described above, the value of the influence in which the timing rate is delayed in the state shown in FIG. 12(*a*) is balanced with the value of the influence in which the timing rate is advanced due to "impact after dead point" in the state shown in FIG. 11(*a*). In addition, the value of the influence in which the timing rate is delayed in the state shown in FIG. 14(*a*) is balanced with the value of the influence in which the timing rate is advanced due to "impact after dead point" in the above-described state shown in FIG. 10(*a*). In addition, more preferably, the total sum of the value of the influence in which the timing rate is delayed in the state shown in FIG. 12(*a*) and the value of the influence in which the timing rate is delayed in the state shown in FIG. 14(*a*) is configured so as to balance with the total sum of the value of the influence in which the timing rate is advanced in the state shown in FIG. 11(*a*), the value of the influence in which the timing rate is advanced in the state shown in FIG. 14(*a*), and the value of the influence in which the timing rate is advanced in the above-described state shown in FIG. 10(*a*). According to the configuration, the detent escapement of the present invention can be configured so that escapement error is significantly decreased compared to the conventional detent escapement.

(2-9) Preferred Configuration of Detent Escapement of the Present Invention

In the detent escapement of the present invention, it is preferable that the unlocking jewel 124 be fixed at a position toward the direction which is far from the escape wheel and pinion 110 based on the rotation reference line 120D. Moreover, in the detent escapement of the present invention, it is more preferable that the unlocking jewel 124 be fixed between a position in which the unlocking jewel is rotated by 10° from the rotation reference line 120D and a position in which the unlocking jewel is rotated by 50° from the rotation reference line 120D toward the direction which is far from the escape wheel and pinion 110. In addition, in the detent escapement of the present invention, it is still more preferable that the unlocking jewel 124 be fixed at a position in which the unlocking jewel is rotated by about 30° from the rotation reference line 120D toward the direction which is far from the escape wheel and pinion 110.

(3) Operation of Detent Escapement of Comparative Example 1

Next, an operation of a detent escapement of Comparative Example 1 will be described with reference to FIGS. 23 to 30. The configuration of the detent escapement of Comparative Example 1 corresponds to the configuration of the conventional detent escapement, and includes a balance which is configured at a dead point position in which the timing rate is delayed. In FIGS. 23 to 30, (a) in the drawings is a plan view showing the operating state of the detent escapement, and (b) in the drawings is a view showing the impact (torque) and the resistance (torque) due to four escapements, that is, the influence on the advance of the timing rate and the influence on the delay of the timing rate due to "impact before dead point", "resistance before dead point", "impact after dead point", and "resistance after dead point".

Figure 23:
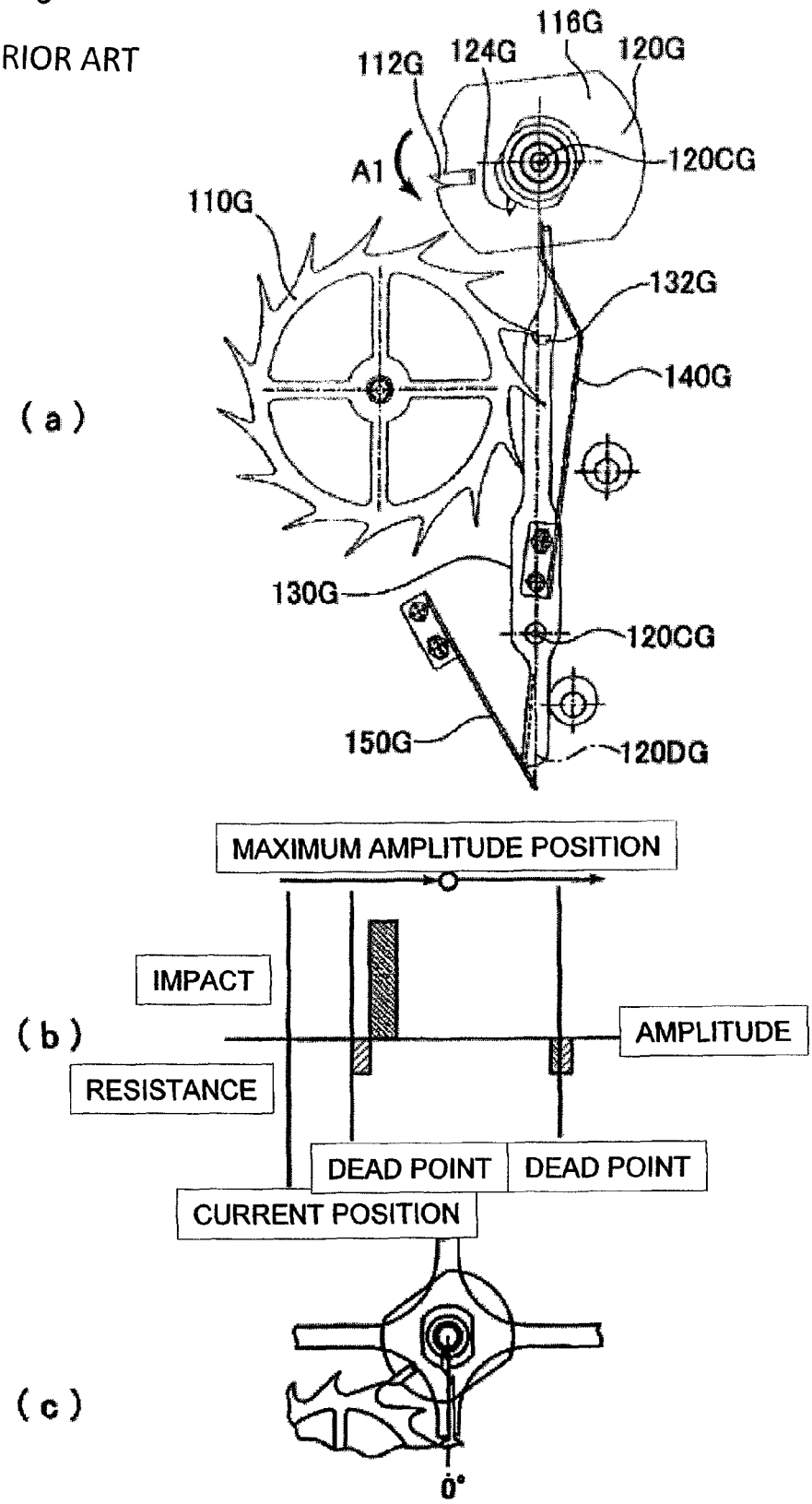
Fig. 23 PRIOR ART
FIG. 23 is a (first) plan view showing an operating state of the escapement in a dead point position in which the timing rate is delayed in the conventional detent escapement.

Referring to FIG. 23(*c*), a straight line which passes through a rotation center 130CG of a blade 130G with a rotation center 120CG of a balance 120G as a starting point in a state where the balance 120G is positioned at a oscillation center is defined as a rotation reference line 120DG. FIG. 23(*c*) is a partial plan view showing a configuration in which the unlocking jewel 124G is fixed at a position on the rotation reference line 120DG. In FIGS. 23(*b*) to 30(*b*), the horizontal axis indicates a rotation angle of the balance 120G and the vertical axis indicates the impact (torque) and the resistance (torque) which are applied to the balance 120G. Here, the influence on the advance of the timing rate is shown by hatchings diagonally rising to the right, and the influence on the delay of the timing rate is shown by hatchings diagonally lowering to the right. Moreover, in FIGS. 23(*b*) to 30(*b*), the "dead point" of the oscillation of the balance 120G (oscillation center of the balance) is shown by a vertical line (solid line). In FIGS. 23(*b*) to 30(*b*), a maximum amplitude position of the balance 120G is shown by a white circle. In FIGS. 23(*b*) to 30(*b*), a current position of the balance 120G is shown by a vertical line (thick solid line).

(3-1) First Operation

Referring to FIG. 23(*a*), the balance 820 performs a free oscillation, and therefore, a large collar 116G rotates in a direction of an arrow A1 (counterclockwise direction). Referring to FIG. 23(*b*), the balance 120G rotates in a counterclockwise direction toward the dead point (oscillation center) from the position shown in FIG. 9(*a*).

(3-2) Second Operation

Figure 24:
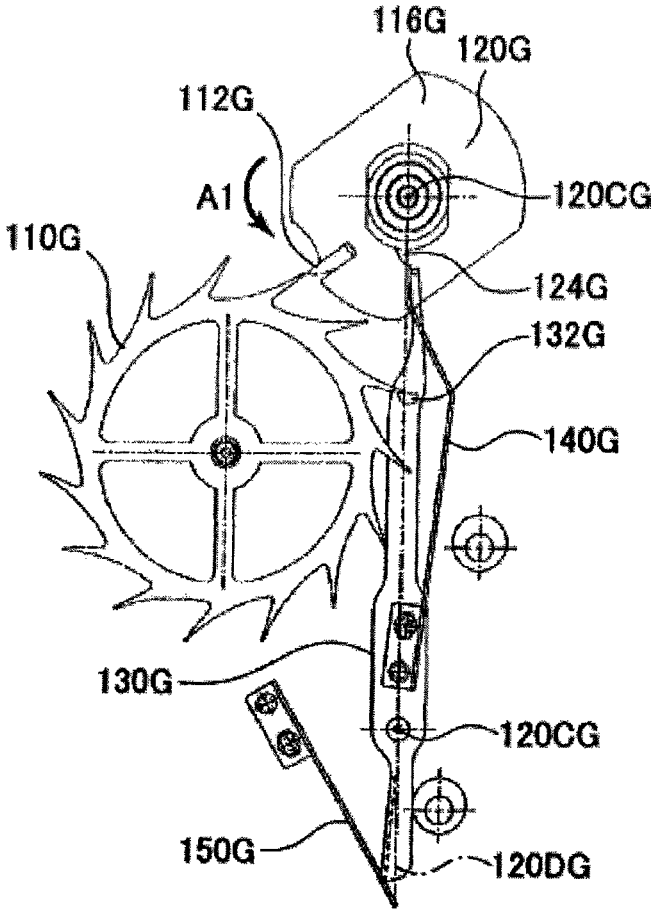
Fig. 24 PRIOR ART
FIG. 24 is a (second) plan view showing the operating state of the escapement in the dead point position in which the timing rate is delayed in the conventional detent escapement.
Figure 24:
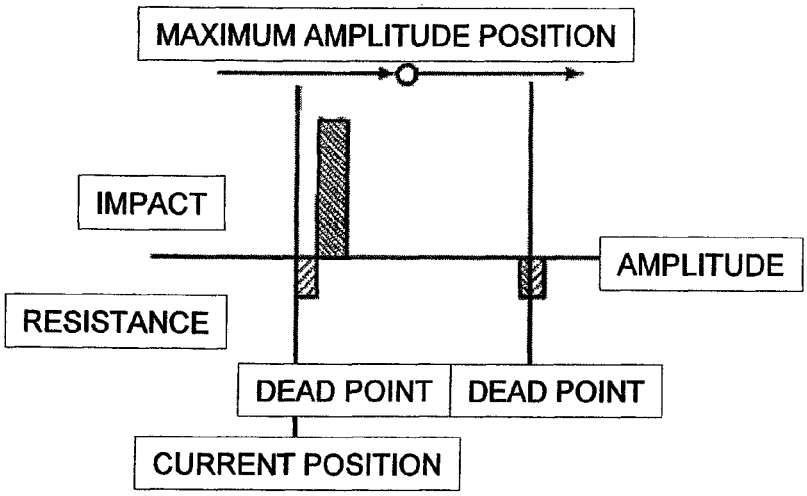
Fig. 24 PRIOR ART

Referring to FIG. 24(*a*), the unlocking jewel 124G which is fixed to the large collar 116G rotates in the direction of the arrow A1 (counterclockwise direction) and the unlocking jewel contacts the unlocking jewel contacting portion of the single blade spring 140G.

(3-3) Third Operation

Figure 25:
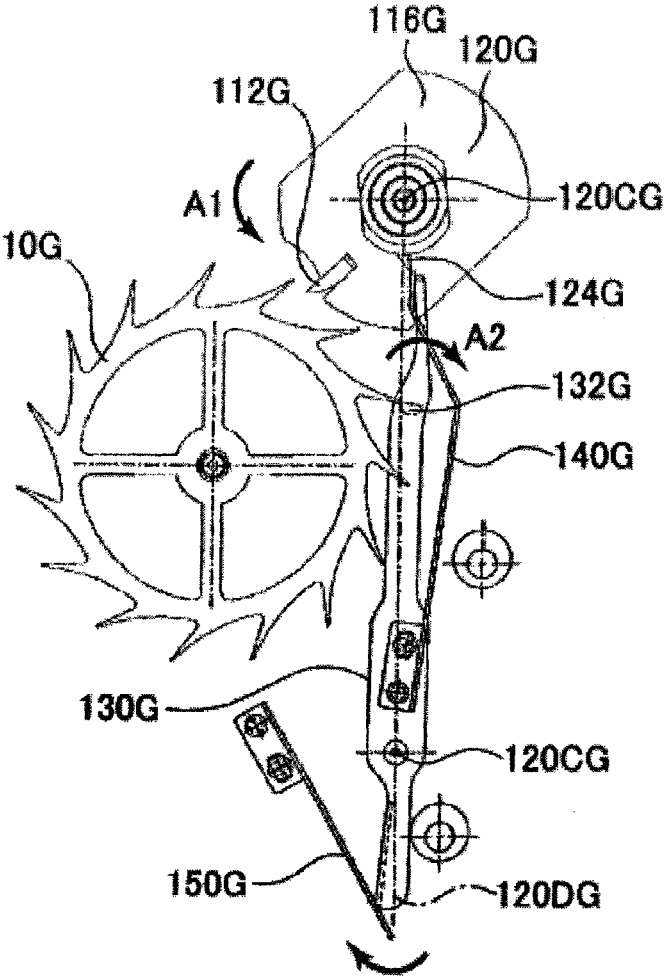
Fig. 25 PRIOR ART
FIG. 25 is a (third) plan view showing the operating state of the escapement in the dead point position in which the timing rate is delayed in the conventional detent escapement.
Figure 25:
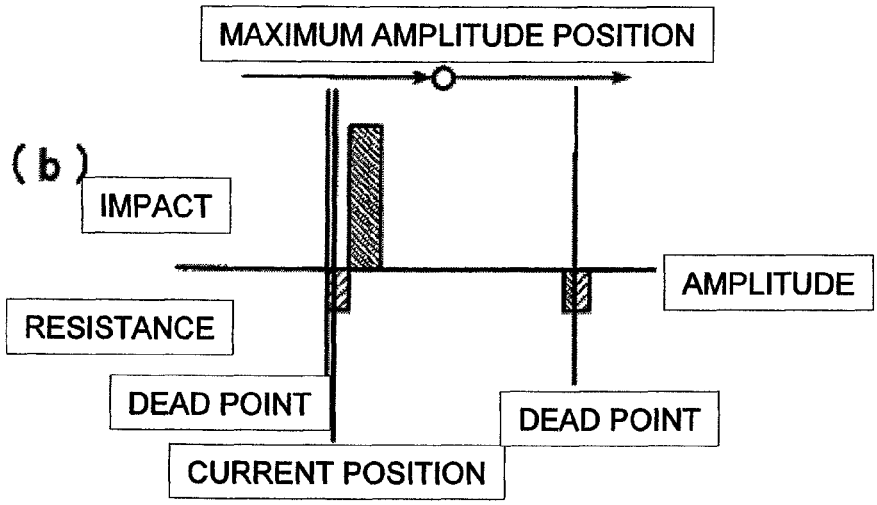
Fig. 25 PRIOR ART

Referring to FIG. 25(*a*), subsequently, the unlocking jewel 124G rotates in the direction of the arrow A1 (counterclockwise direction), the single blade spring 140G is pressed to the unlocking jewel 124G, and the single blade spring presses the spring bearing protrusion. Thereby, the blade 130G rotates in the direction of the arrow A2 (clockwise direction). The tip of the tooth portion of the escape wheel and pinion 110 slides on the contact plane of the locking jewel 112G. According to the operation in which the blade 130G rotates in the direction of the arrow A2 (clockwise direction), the blade body is separated from the adjusting eccentric pin. Referring to FIG. 25(*b*), the balance 120G receives "resistance after dead point", and therefore, the balance receives the influence in which the timing rate is advanced. The value of the influence in which the timing rate is delayed in the state shown in FIG. 25(*a*) is smaller than the value of the influence in which the timing rate is delayed due to "impact after dead point" in a state shown in FIG. 26(*a*) which is generated after the state of FIG. 25(*a*).

(3-4) Fourth Operation

Figure 26:
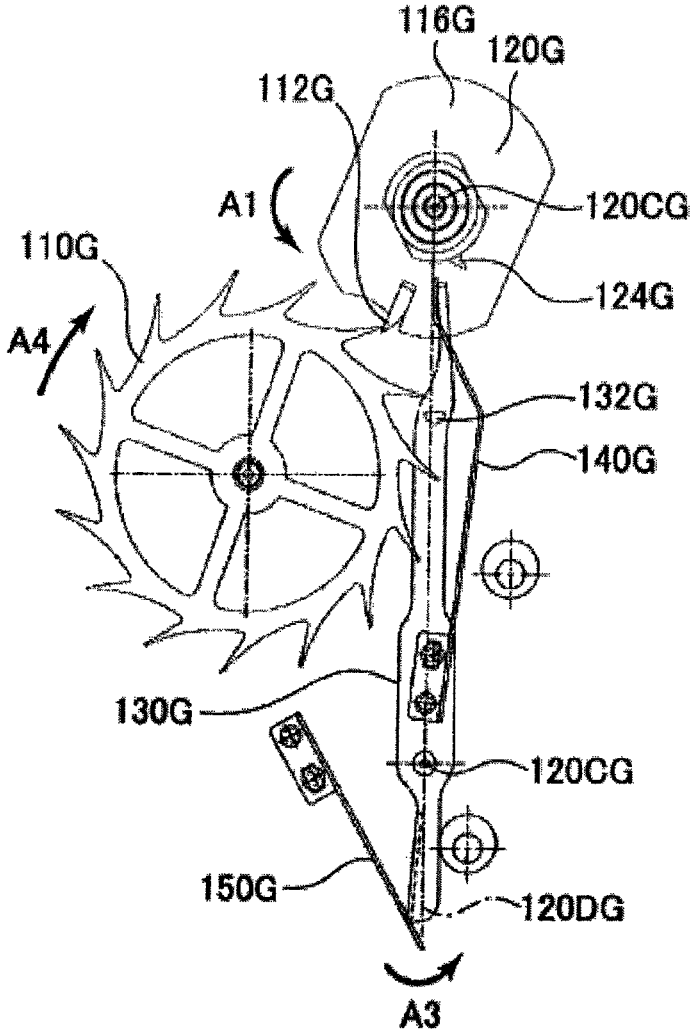
Fig. 26 PRIOR ART
FIG. 26 is a (fourth) plan view showing the operating state of the escapement in the dead point position in which the timing rate is delayed in the conventional detent escapement.
Figure 26:
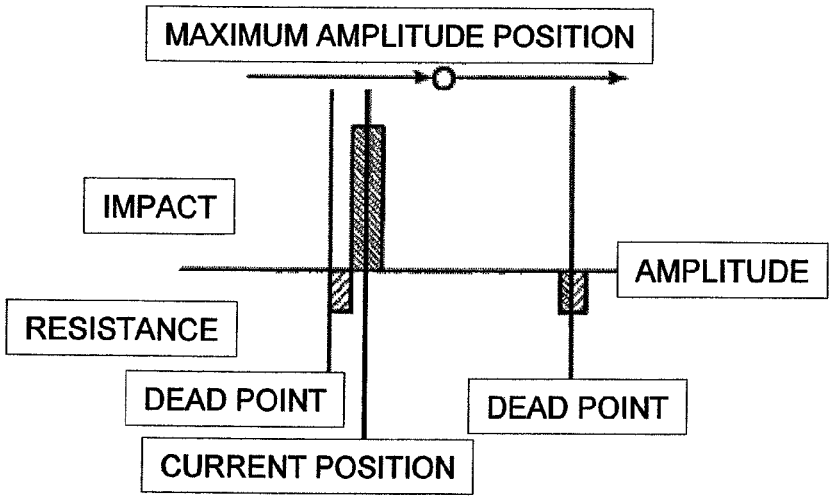
Fig. 26 PRIOR ART

Referring to FIG. 26(*a*), the tip of the tooth portion of the escape wheel and pinion 110G contacts the contact plane of the locking jewel 112G. The escape wheel and pinion 110G is rotated by the front train wheel which is rotated by the turning force when the mainspring is rewound and the escape wheel and pinion 110G is driven. The escape wheel and pinion 110G rotates in the direction of the arrow A4 (clockwise direction), the tip of the tooth portion of the escape wheel and pinion 110G contacts the impulse pin 112G, and the turning force is transmitted to the balance 120G. If the large collar 116G rotates up to a predetermined angle in the direction of the arrow A1 (counterclockwise direction), the unlocking jewel 124G is separated from the unlocking jewel contacting portion of the single blade spring 140G. The blade 130G is rotated in the direction of the arrow A3 (counterclockwise direction) by the spring force of the balance spring 150G and is returned to the original position. The tip of the tooth portion of the escape wheel and pinion 110G, which contacts the contact plane B of the locking jewel 112G, is slipped-off from the locking jewel 112G (the escape wheel and pinion 110G is released). The blade 130G is rotated in the direction of the arrow A3 (counterclockwise direction) by the spring force of the balance spring 150G and the blade body is pushed back toward the adjusting eccentric pin. The balance 120G receives "impact after dead point" and therefore, receives the influence in which the timing rate is delayed. The value of the influence in which the timing rate is delayed in the state shown in FIG. 26(*a*) is greater than the value of the influence in which the timing rate is advanced due to "resistance after dead point" in the state shown in FIG. 25(*a*).

(3-5) Fifth Operation

Figure 27:
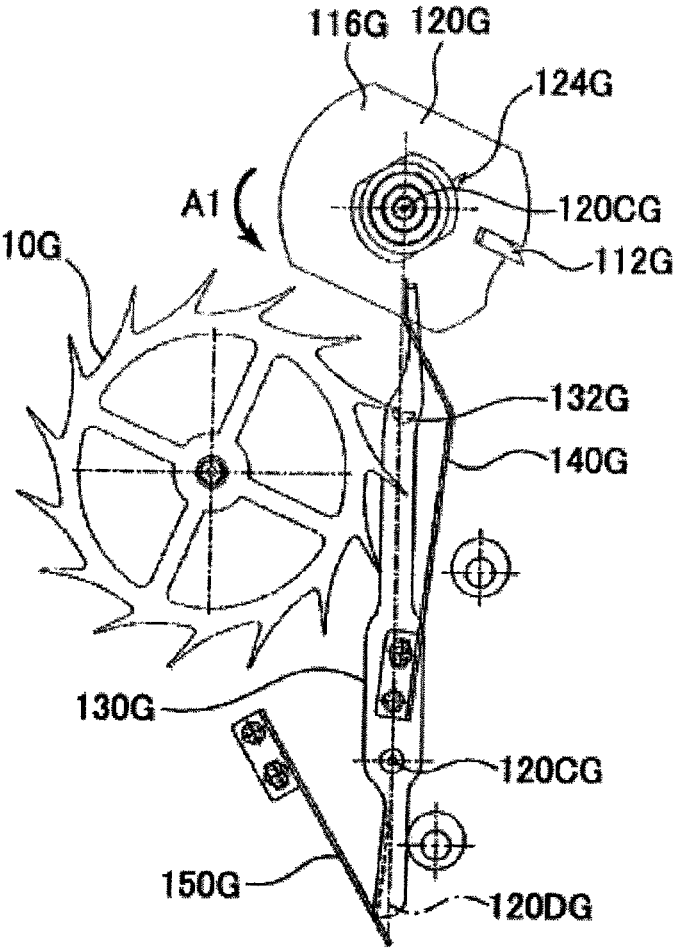
Fig. 27 PRIOR ART
FIG. 27 is a (fifth) plan view showing the operating state of the escapement in the dead point position in which the timing rate is delayed in the conventional detent escapement.
Figure 27:
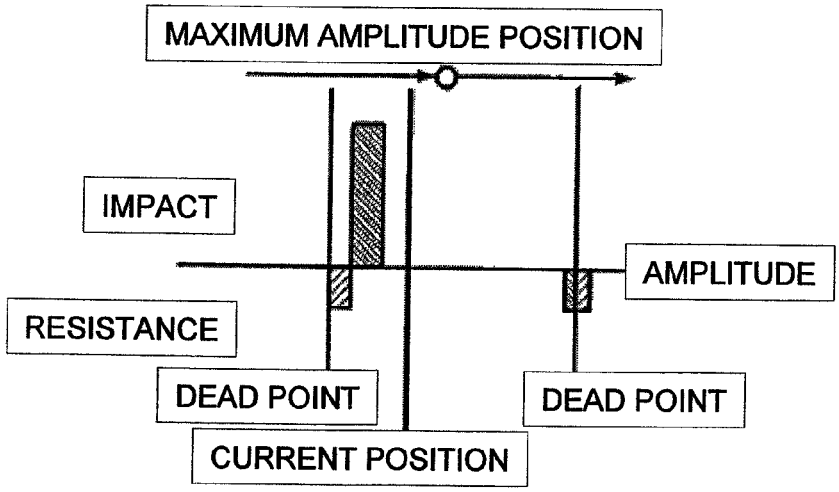
Fig. 27 PRIOR ART

Referring to FIG. 27(*a*), the balance 120G performs a free oscillation in the direction of the arrow A1 (counterclockwise direction), and therefore, the balance 120G rotates toward the maximum amplitude position of the balance 120G.

(3-6) Sixth Operation

Figure 28:
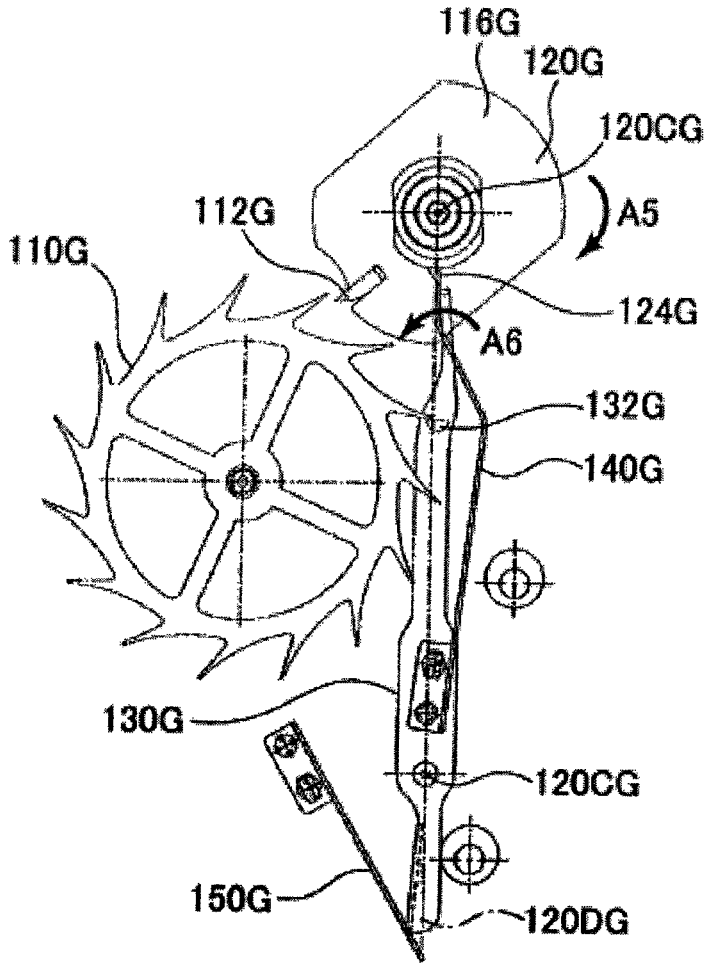
Fig. 28 PRIOR ART
FIG. 28 is a (sixth) plan view showing the operating state of the escapement in the dead point position in which the timing rate is delayed in the conventional detent escapement.
Figure 28:
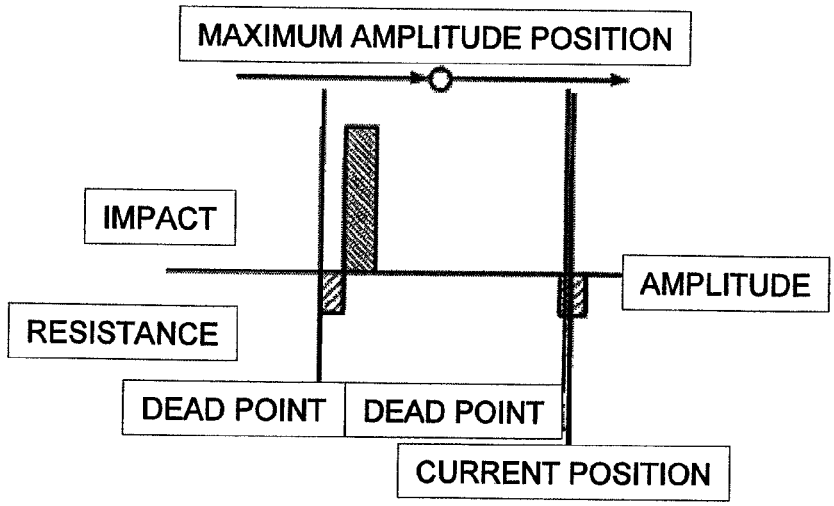
Fig. 28 PRIOR ART

Referring to FIG. 28(*a*), the balance 120G further oscillates freely, and therefore, the balance 120G crosses over the maximum amplitude position of the balance 120G. Thereby, the large collar 116G rotates in the direction of the arrow A5 (clockwise direction). The unlocking jewel 124G which is fixed to the large collar 116G rotates in the direction of the arrow A5 (clockwise direction) and the unlocking jewel contacts the unlocking jewel contacting portion of the single blade spring 140G. The unlocking jewel 124G rotates in the direction of the arrow A5 (clockwise direction) and the single blade spring 140G is pressed to the unlocking jewel 124G. At this time, the blade spring 140G is separated from the spring bearing protrusion of the blade 130G. Therefore, only the single blade spring 140G is pushed to the direction of the arrow A6 (counterclockwise direction) by the unlocking jewel 124G in a state where the blade 130G is stationary. Referring to FIG. 28(*b*), the balance 120G receives "resistance before dead point", and therefore, receives the influence in which the time rate is delayed.

(3-7) Seventh Operation

Figure 29:
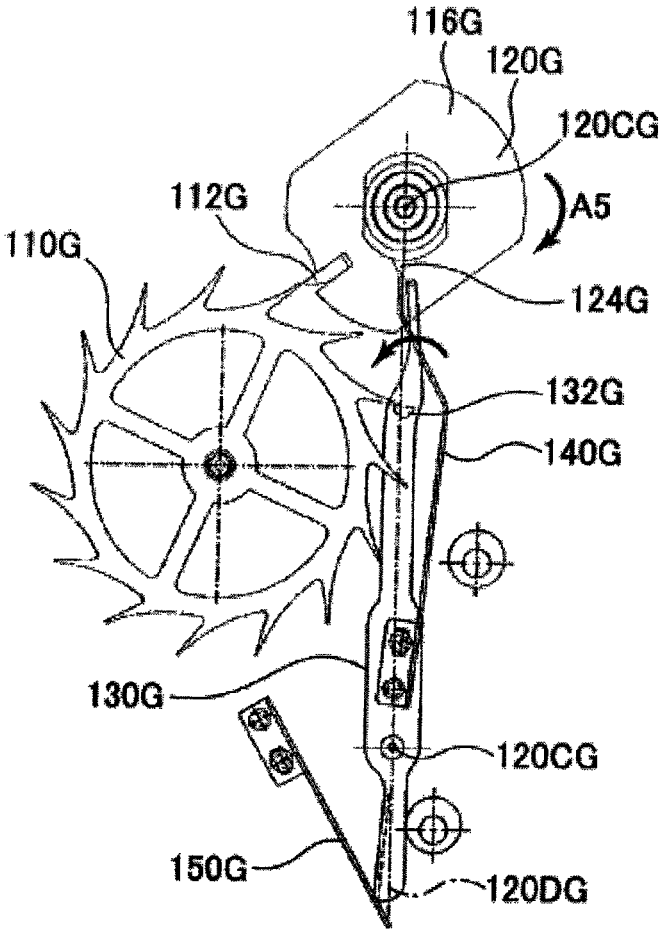
Fig. 29 PRIOR ART
FIG. 29 is a (seventh) plan view showing the operating state of the escapement in the dead point position in which the timing rate is delayed in the conventional detent escapement.
Figure 29:
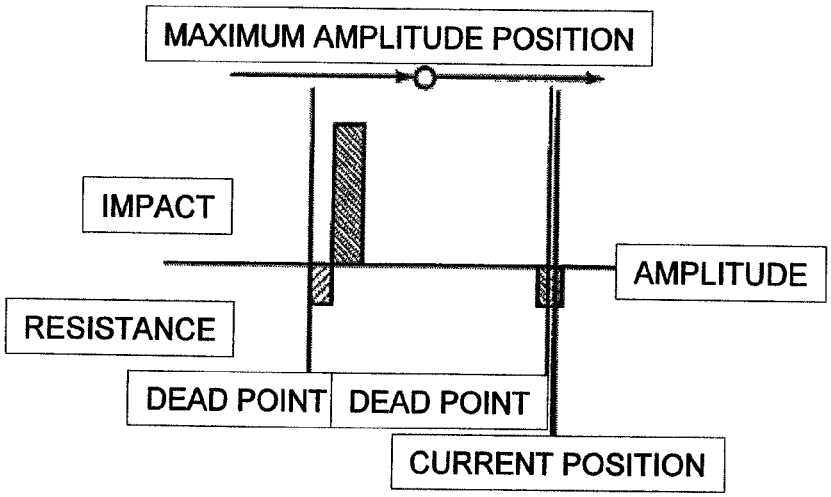
Fig. 29 PRIOR ART

Referring to FIG. 29(*a*), the balance 120G performs a free oscillation in the direction of the arrow A5 (clockwise direction), and therefore, the tip of the next tooth portion of the escape wheel and pinion 110G falls to the contact plane of the locking jewel 112G. The tip of the tooth portion of the escape wheel and pinion 110G contacts the impulse pin 112G, the turning force is transmitted to the balance 120G, and the balance 120G passes through the dead point (oscillation center) and rotates. The blade body of the blade 130G contacts the adjusting eccentric pin by the spring force of the balance spring 150G. The balance 120G receives "resistance after dead point", and therefore, receives the influence in which the timing rate is advanced. The value of the influence in which the timing rate is advanced in the state shown in FIG. 29(*a*) is smaller than the value of the influence in which the timing rate is advanced due to "impact after dead point" in the above-described state shown in FIG. 26(*a*).

(3-8) Eighth Operation

Figure 30:
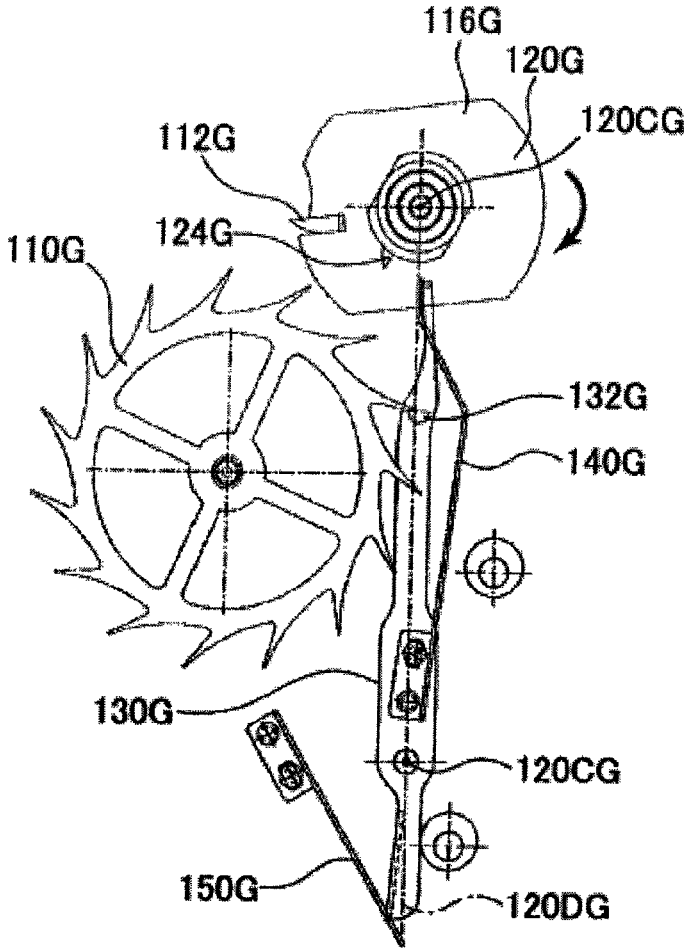
Fig. 30 PRIOR ART
FIG. 30 is a (eighth) plan view showing the operating state of the escapement in the dead point position in which the timing rate is delayed in the conventional detent escapement.
Figure 30:
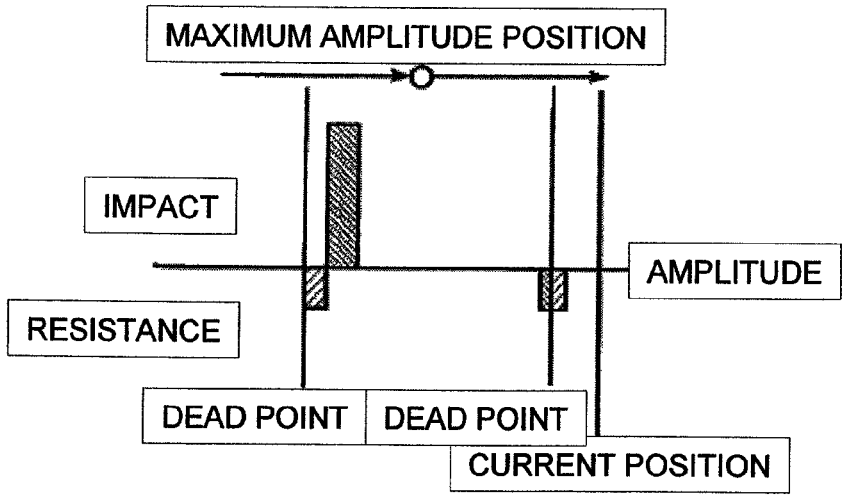
Fig. 30 PRIOR ART

Referring to FIG. 30(*a*), the balance 120G further performs a free oscillation, and therefore, the balance 120G rotates toward the next dead point.

(3-9) Repeat of Operation

Hereinafter, similarly, the operations from the state shown in FIG. 23 to the state shown in FIG. 30 are repeated. As described above, the value of the influence in which the timing rate is delayed in the state shown in FIG. 26(*a*) is greater than the value of the influence in which the timing rate is advanced due to "resistance after dead point" in the state shown in FIG. 25(*a*). Moreover, as described above, the value of the influence in which the timing rate is delayed in the state shown in FIG. 26(*a*) is greater than the value of the influence in which the timing rate is advanced due to "resistance after dead point" in the state shown in FIG. 28(*a*). Moreover, a value which sums the value of the influence in which the timing rate is delayed in the state shown in FIG. 26(*a*) and the value of the influence in which the timing rate is delayed due to "resistance before dead point" in the state shown in FIG. 28(*a*) is greater than a value which sums the value of the influence in which the timing rate is advanced due to "resistance after dead point" in the state shown in FIG. 25(*a*) and the value of the influence in which the timing rate is advanced due to "resistance after dead point" in the state shown in FIG. 29(*a*). Therefore, in the detent escapement of Comparative Example 1, the influence in which the timing rate is delayed is great, and escapement error is larger compared to the detent escapement of the present invention.

(4) Operation of Detent Escapement of Comparative Example 2

Figure 31:
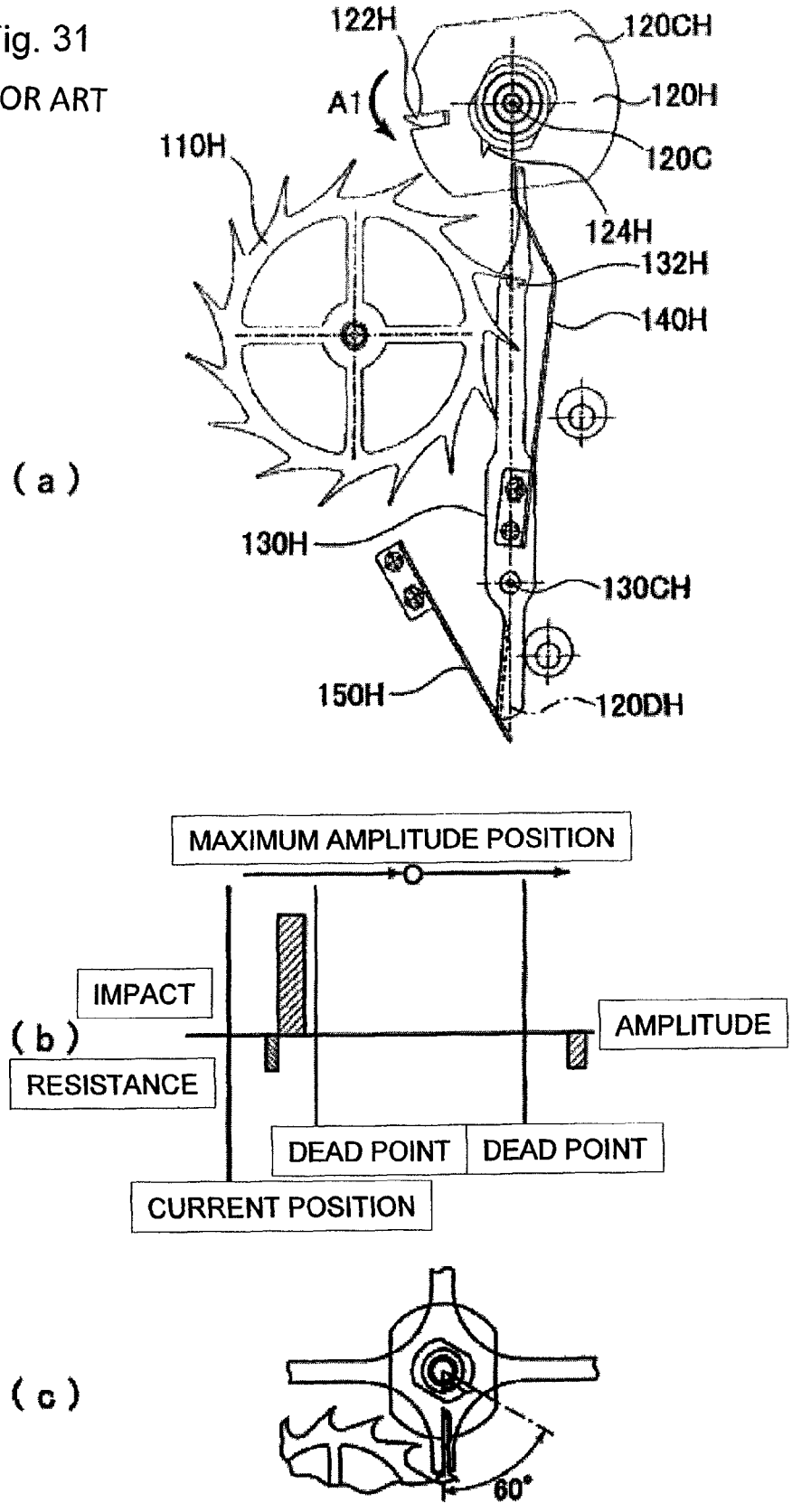
Fig. 31 PRIOR ART
FIG. 31 is a (first) plan view showing the operating state of the escapement in the dead point position in which the timing rate is delayed.

Next, an operation of a detent escapement of Comparative Example 2 will be described with reference to FIGS. 31 to 37. The configuration of the detent escapement of Comparative Example 2 includes a balance which is configured at a dead point position in which the timing rate is advanced. In FIGS. 31 to 37, (a) in the drawings is a plan view showing the operating state of the detent escapement of the Comparative Example, and (b) in the drawings is a view showing the impact (torque) and the resistance (torque) due to four escapements, that is, the influence on the advance of the timing rate and the influence on the delay of the timing rate due to "impact before dead point", "resistance before dead point", "impact after dead point", and "resistance after dead point". FIG. 31(*c*) is a partial plan view showing a configuration in which an unlocking jewel 124H is fixed at the position of 60° in a counterclockwise direction from a rotation reference line 120DH in a position toward a direction far from an escape wheel and pinion 110H based on the rotation reference line 120DH. In FIGS. 31(*b*) to 37(*b*), a horizontal axis indicates a rotation angle of a balance 120H and a vertical axis indicates the impact (torque) and the resistance (torque) which are applied to the balance 120H. Here, the influence on the advance of the timing rate is shown by hatchings diagonally rising to the right, and the influence on the delay of the timing rate is shown by hatchings diagonally lowering to the right. Moreover, in FIGS. 31(*b*) to 37(*b*), the "dead point" of the oscillation of the balance 120H (oscillation center of the balance) is shown by a vertical line (solid line). In FIGS. 31(*b*) to 37(*b*), a maximum amplitude position of the balance 120H is shown by a white circle. In FIGS. 31(*b*) to 37(*b*), a current position of the balance 120H is shown by a vertical line (thick solid line).

(4-1) First Operation

Referring to FIG. 31(*a*), the balance 120H performs a free oscillation, and therefore, a large collar 116H rotates in the direction of the arrow A1 (counterclockwise direction). Referring to FIG. 31(*b*), the balance 120H rotates in a counterclockwise direction toward the dead point (oscillation center) from the position shown in FIG. 31(*a*).

(4-2) Second Operation

Figure 32:
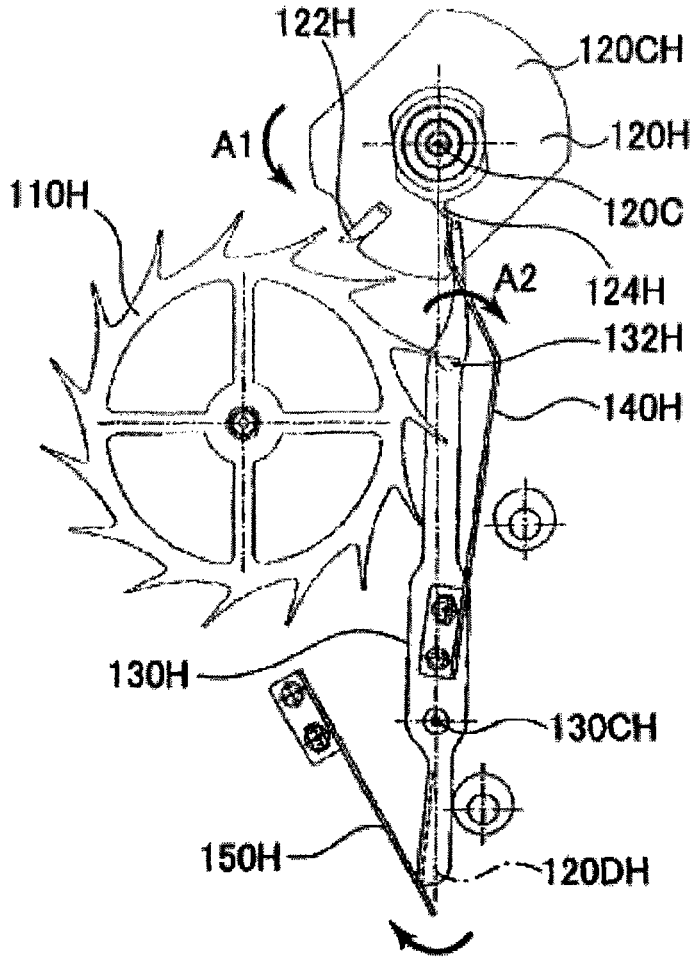
Fig. 32 PRIOR ART
FIG. 32 is a (second) plan view showing the operating state of the escapement in the dead point position in which the timing rate is delayed.
Figure 32:
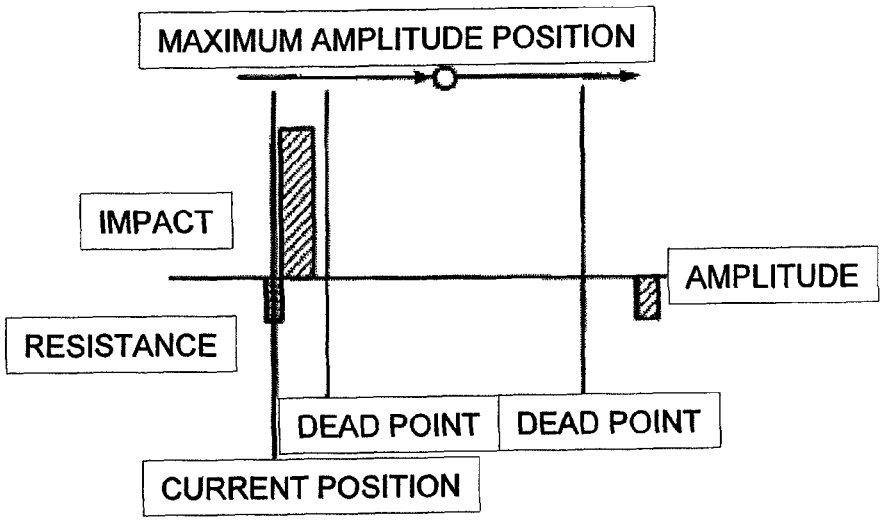
Fig. 32 PRIOR ART

Referring to FIG. 32(*a*), the unlocking jewel 124H which is fixed to the large collar 116H rotates in the direction of the arrow A1 (counterclockwise direction) and the unlocking jewel contacts an unlocking jewel contacting portion of a single blade spring 140H. Subsequently, the unlocking jewel 124H rotates in the direction of the arrow A1 (counterclockwise direction), the single blade spring 140H is pressed to the unlocking jewel 124H, and the single blade spring presses the spring bearing protrusion. Thereby, the blade 130H rotates in the direction of the arrow A2 (clockwise direction). The tip of the tooth portion of the escape wheel and pinion 110H slides on the contact plane of the locking jewel 132H. According to the operation in which the blade 130H rotates in the direction of the arrow A2 (clockwise direction), the blade body is separated from the adjusting eccentric pin. Referring to FIG. 32(*b*), the balance 120H receives "resistance before dead point", and therefore, the balance receives the influence in which the timing rate is delayed. The value of the influence in which the timing rate is delayed in the state shown in FIG. 32(*a*) is smaller than the value of the influence in which the timing rate is advanced due to "impact before dead point" in a state shown in FIG. 33(*a*) which is generated after the state of FIG. 32(*a*).

(4-3) Third Operation

Figure 33:
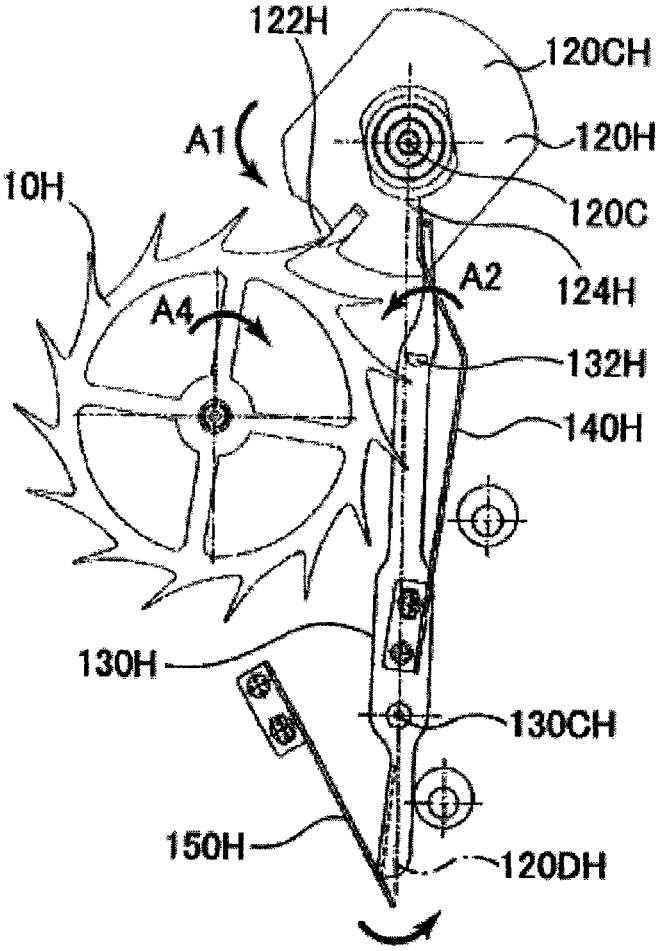
Fig. 33 PRIOR ART
FIG. 33 is a (third) plan view showing the operating state of the escapement in the dead point position in which the timing rate is delayed in the conventional detent escapement.
Figure 33:
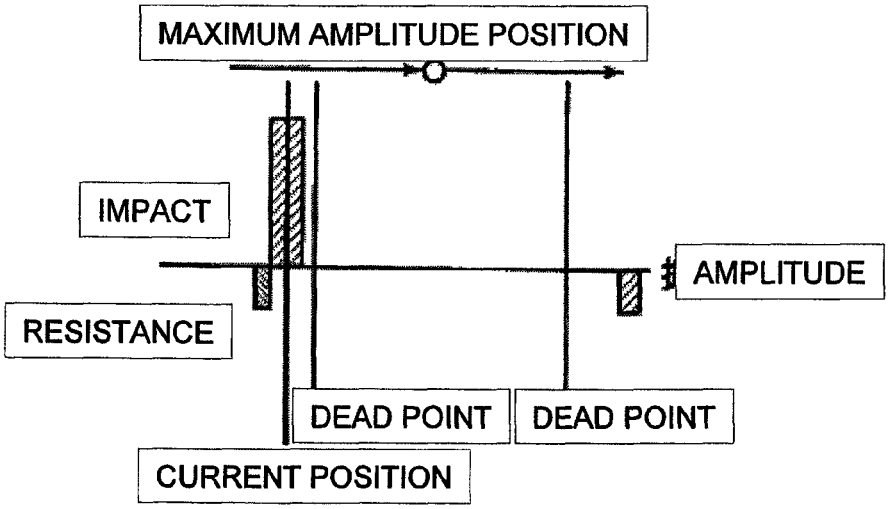
Fig. 33 PRIOR ART

Referring to FIG. 33(*a*), the tip of the tooth portion of the escape wheel and pinion 110H contacts the contact plane of the locking jewel 132H. The escape wheel and pinion 110H is rotated by the front train wheel which is rotated by the turning force when the mainspring is rewound and the escape wheel and pinion 110H is driven. The escape wheel and pinion 110H rotates in the direction of the arrow A4 (clockwise direction), the tip of the tooth portion of the escape wheel and pinion 110H contacts the impulse pin 122H, and the turning force is transmitted to the balance 120H. If the large collar 116H rotates up to a predetermined angle in the direction of the arrow A1 (counterclockwise direction), the unlocking jewel 124H is separated from the unlocking jewel contacting portion of the single blade spring 140H. The blade 130H is rotated in the direction of the arrow A3 (counterclockwise direction) by the spring force of a balance spring 150H and returns to the original position. The tip of the tooth portion of the escape wheel and pinion 110H, which contacts the contact plane of the locking jewel 132H, is slipped-off from the locking jewel 132H (the escape wheel and pinion 110 is released). The blade 130H is rotated in the direction of the arrow A3 (counterclockwise direction) by the spring force of the balance spring 150H and the blade body is pushed back toward the adjusting eccentric pin. The balance 120H receives "impact before dead point" and therefore, the balance receives the influence in which the timing rate is advanced. The value of the influence in which the timing rate is advanced in the state shown in FIG. 33(*a*) is greater than the value of the influence in which the timing rate is delayed due to "resistance before dead point" in the state shown in FIG. 32(*a*).

(4-4) Fourth Operation

Figure 34:
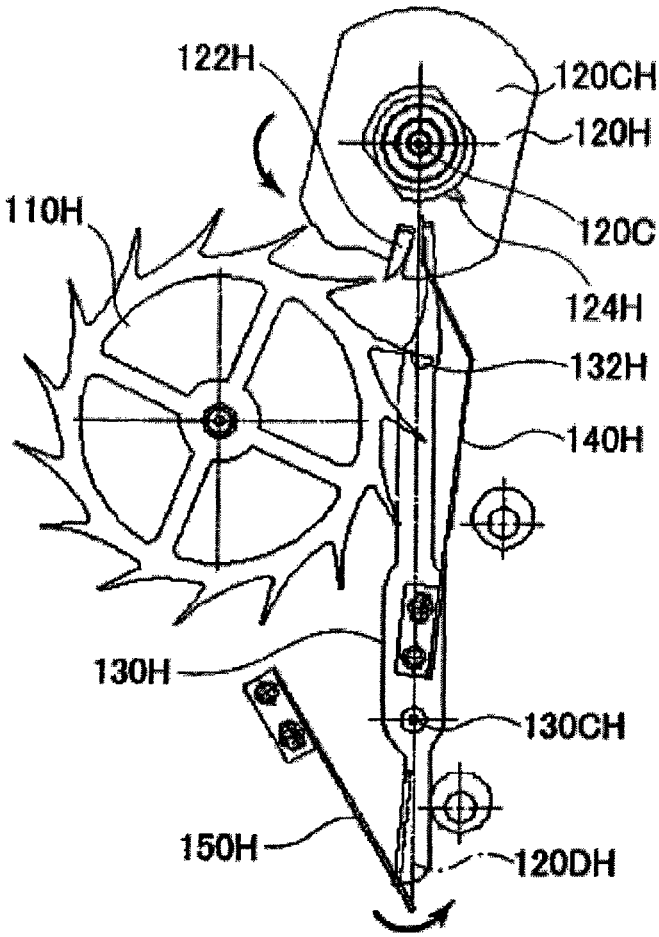
Fig. 34 PRIOR ART
FIG. 34 is a (fourth) plan view showing the operating state of the escapement in the dead point position in which the timing rate is delayed in the conventional detent escapement.
Figure 34:
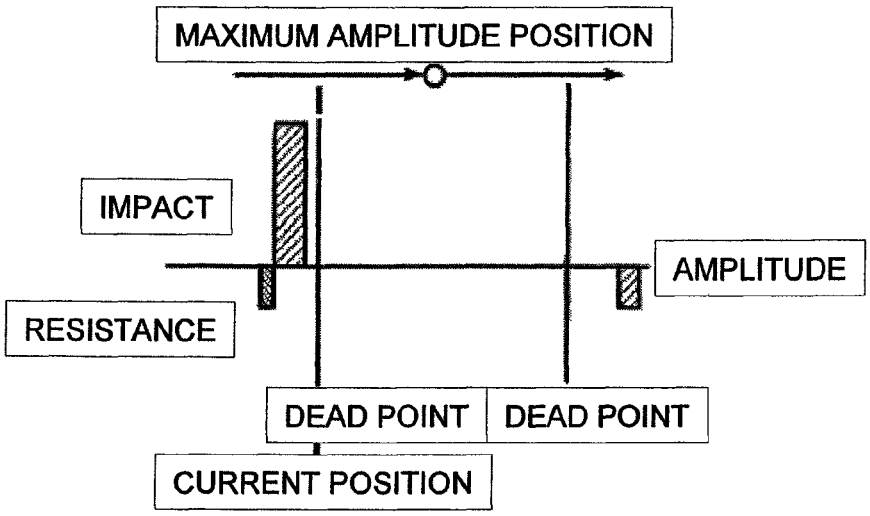
Fig. 34 PRIOR ART

Referring to FIG. 34(*a*), continuously, the tip of the tooth portion of the escape wheel and pinion 110H contacts the impulse pin 122H, the turning force is transmitted to the balance 120H, and the balance 120H passes through the dead point (oscillation center) and rotates. The blade body of the blade 130H contacts the adjusting eccentric pin by the spring force of the balance spring 150H.

(4-5) Fifth Operation

Figure 35:
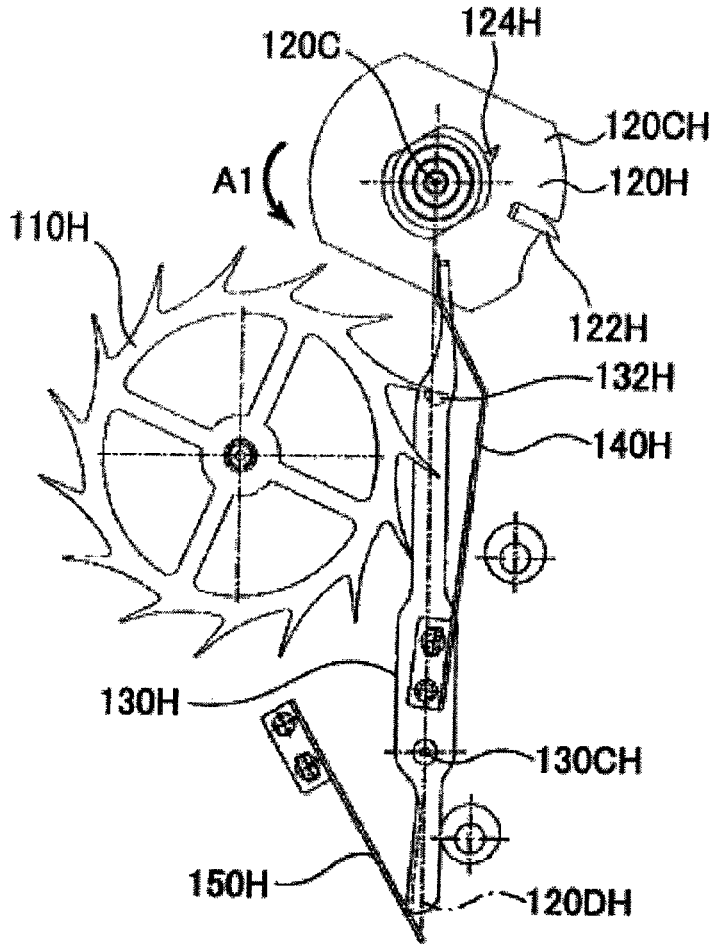
Fig. 35 PRIOR ART
FIG. 35 is a (fifth) plan view showing the operating state of the escapement in the dead point position in which the timing rate is delayed in the conventional detent escapement.
Figure 35:
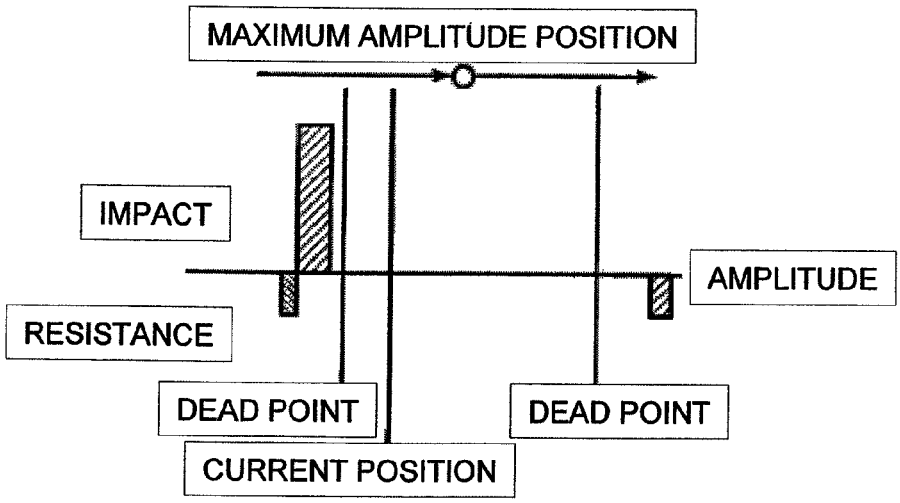
Fig. 35 PRIOR ART

Referring to FIG. 35(*a*), the balance 120H performs a free oscillation in the direction of the arrow A1 (counterclockwise direction), and therefore, the tip of the next tooth portion of the escape wheel and pinion 110H falls to the contact plane of the locking jewel 132H.

(4-6) Sixth Operation

Figure 36:
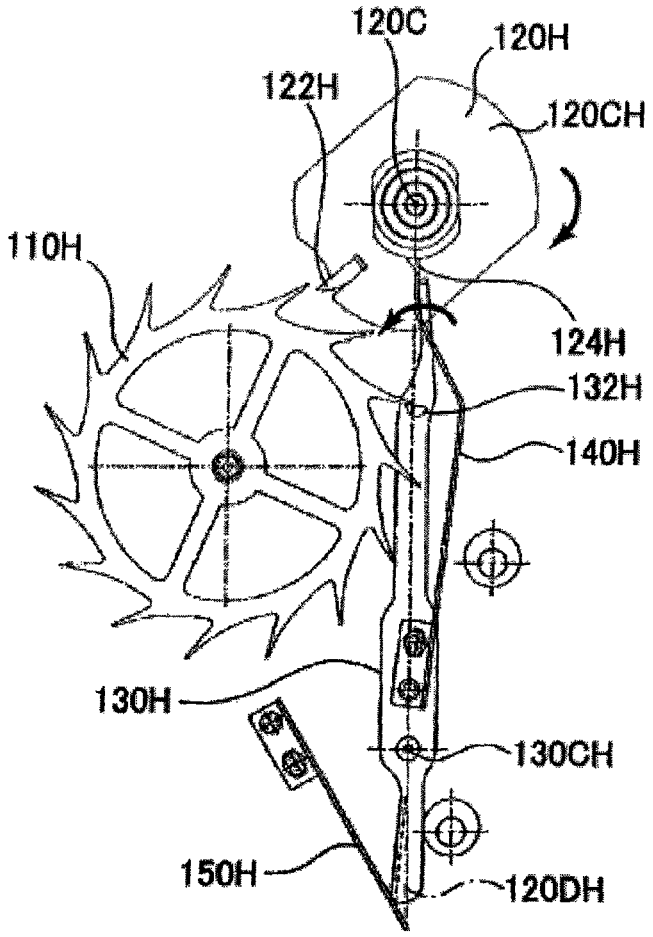
Fig. 36 PRIOR ART
FIG. 36 is a (sixth) plan view showing the operating state of the escapement in the dead point position in which the timing rate is delayed in the conventional detent escapement.
Figure 36:
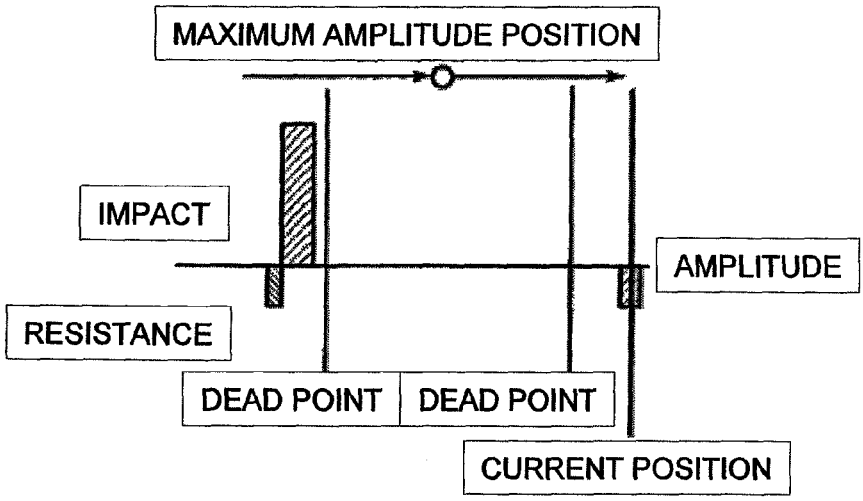
Fig. 36 PRIOR ART

Referring to FIG. 36(*b*), the balance 120H further oscillates freely, and therefore, the balance 120H crosses over the maximum amplitude position of the balance 120H. Thereby, the large collar 116H rotates in the direction (clockwise direction) opposite to the direction of the arrow A1. The unlocking jewel 124H which is fixed to the large collar 116H rotates in the direction of the arrow A5 (clockwise direction) and the unlocking jewel contacts the unlocking jewel contacting portion of the single blade spring 140H. The unlocking jewel 124H rotates in the direction of the arrow A5 (clockwise direction) and the single blade spring 140H is pressed to the unlocking jewel 124H. At this time, the blade spring 140H is separated from the spring bearing protrusion of the blade 130H. Therefore, only the single blade spring 140H is pushed to the direction of the arrow A6 (counterclockwise direction) by the unlocking jewel 124H in a state where the blade 130H is stationary. Referring to FIG. 36(*b*), the balance 120H receives "resistance after dead point", and therefore, receives the influence in which the time rate is advanced. The value of the influence in which the timing rate is advanced in the state shown in FIG. 36(*a*) is smaller than the value of the influence in which the timing rate is advanced due to "impact before dead point" in the above-described state shown in FIG. 33(*a*).

(4-7) Seventh Operation

Figure 37:
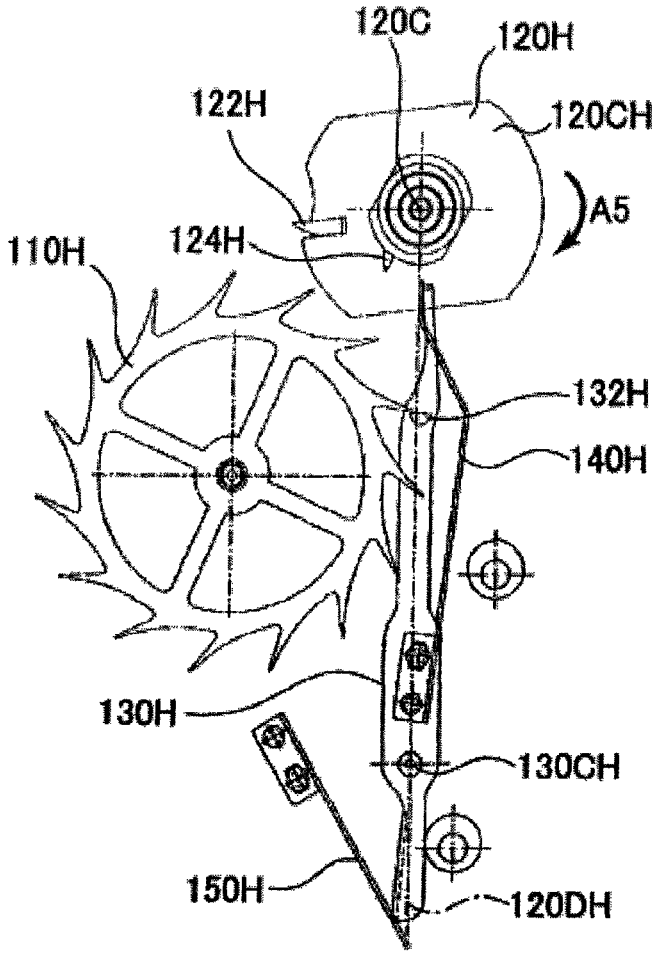
Fig. 37 PRIOR ART
FIG. 37 is a (seventh) plan view showing the operating state of the escapement in the dead point position in which the timing rate is delayed in the conventional detent escapement.
Figure 37:
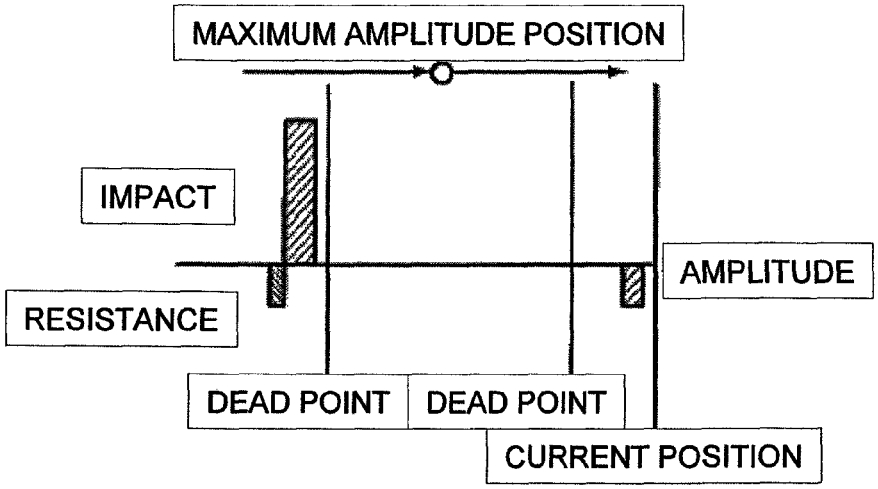
Fig. 37 PRIOR ART

Referring to FIG. 37(*a*), if the large collar 116H rotates up to a predetermined angle in the direction of the arrow A5 (clockwise direction), the unlocking jewel 124H is separated from the unlocking jewel contacting portion of the single blade spring 140H. Thereby, the single blade spring 140H returns to the original position and the balance 120H performs a free oscillation. Referring to FIG. 37(*b*), the balance 120H further performs a free oscillation, and therefore, the balance 120H rotates toward the next maximum amplitude position.

(4-8) Repeat of Operation

Hereinafter, similarly, the operations from the state shown in FIG. 31 to the state shown in FIG. 37 can be repeated. As described above, the value of the influence in which the timing rate is delayed in the state shown in FIG. 33(*a*) is greater than the value of the influence in which the timing rate is delayed in the state shown in FIG. 32(*a*). Moreover, the value of the influence in which the timing rate is delayed in the state shown in FIG. 33(*a*) is greater than the value of the influence in which the timing rate is delayed in the state shown in FIG. 36(*a*). In addition, the value of the influence in which the timing rate is advanced in the state shown in FIG. 33(*a*) is greater than a value which sums the value of the influence in which the timing rate is delayed in the state shown in FIG. 32(*a*) and the value of influence in which the timing rate is delayed in the state shown in FIG. 36(*a*). Therefore, in the detent escapement of Comparative Example 2, the influence in which the timing rate is advanced is great, and escapement error is larger compared to the detent escapement of the present invention.

Figure 18:
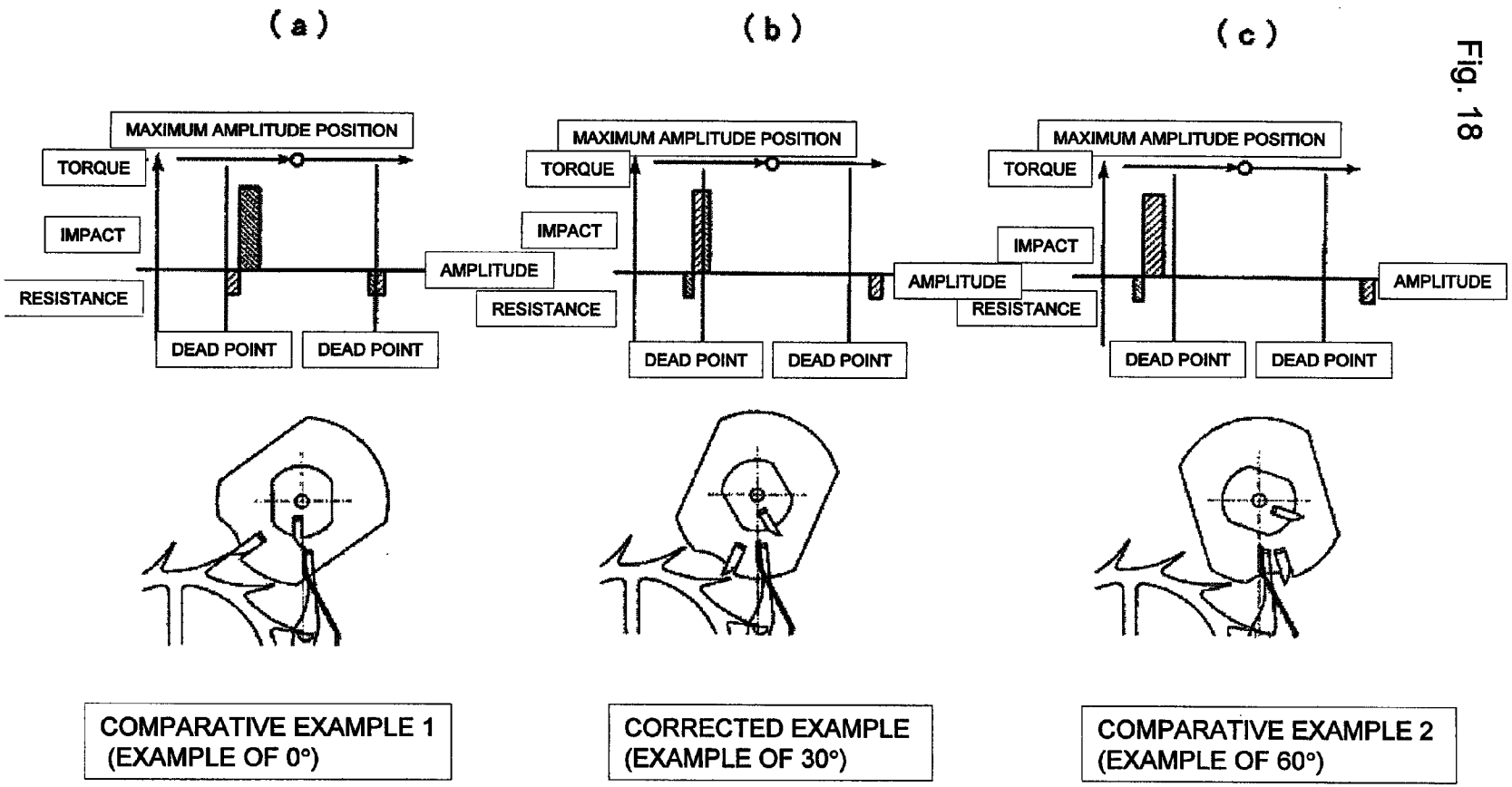
FIG. 18 are graphs of torque and plan views of the balance showing position changes of impact and resistance due to a position adjustment of a dead point in the detent escapement.
Figure 19:
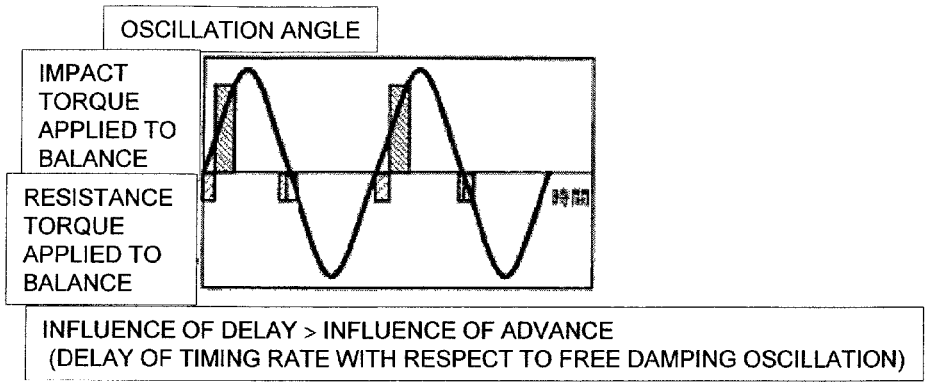
FIG. 19 is graphs showing position changes of impact and resistance due to the position adjustment of the dead point in the detent escapement.
Figure 19:
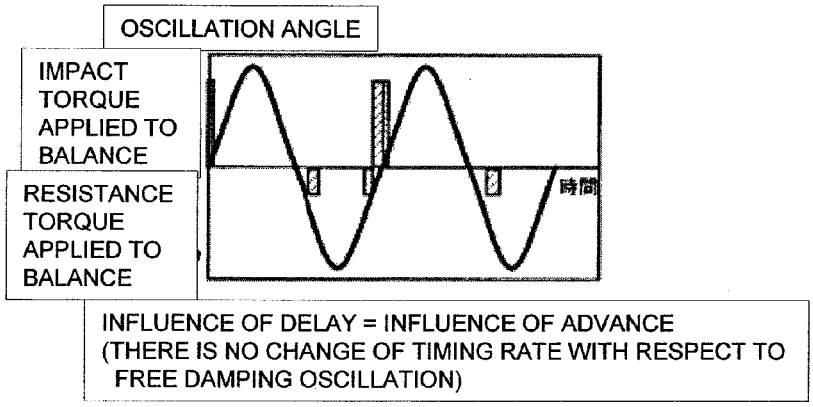
Figure 19:
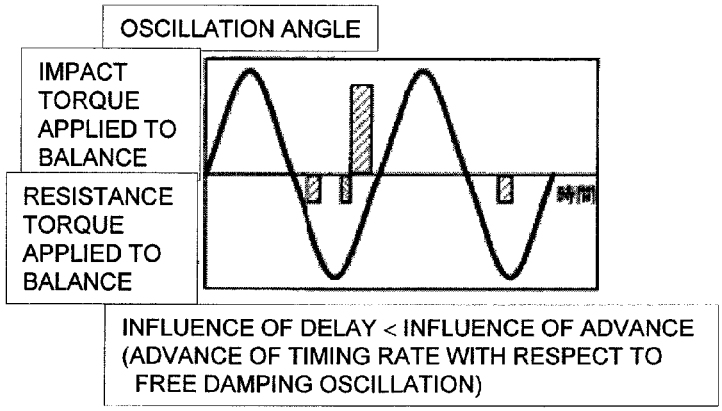
Figure 20:
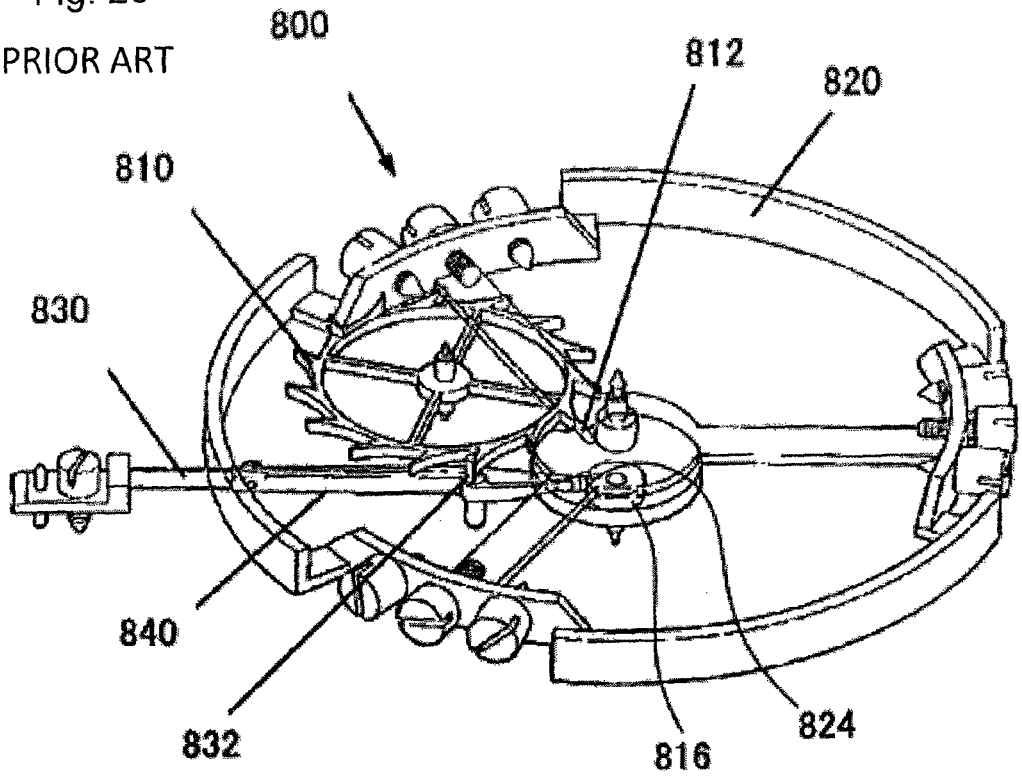
Fig. 20 PRIOR ART
FIG. 20 is a perspective view showing the structure of the conventional spring detent escapement.
Figure 21:
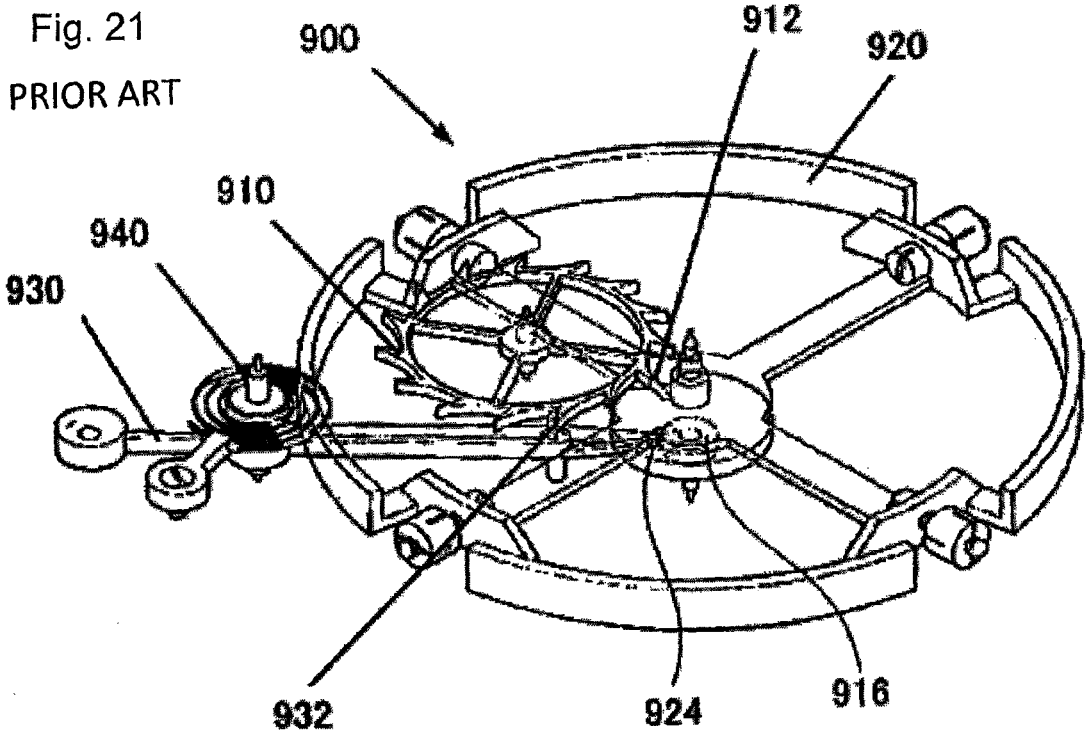
Fig. 21 PRIOR ART
FIG. 21 is a perspective view showing the structure of the conventional pivoted detent escapement.
Figure 22:
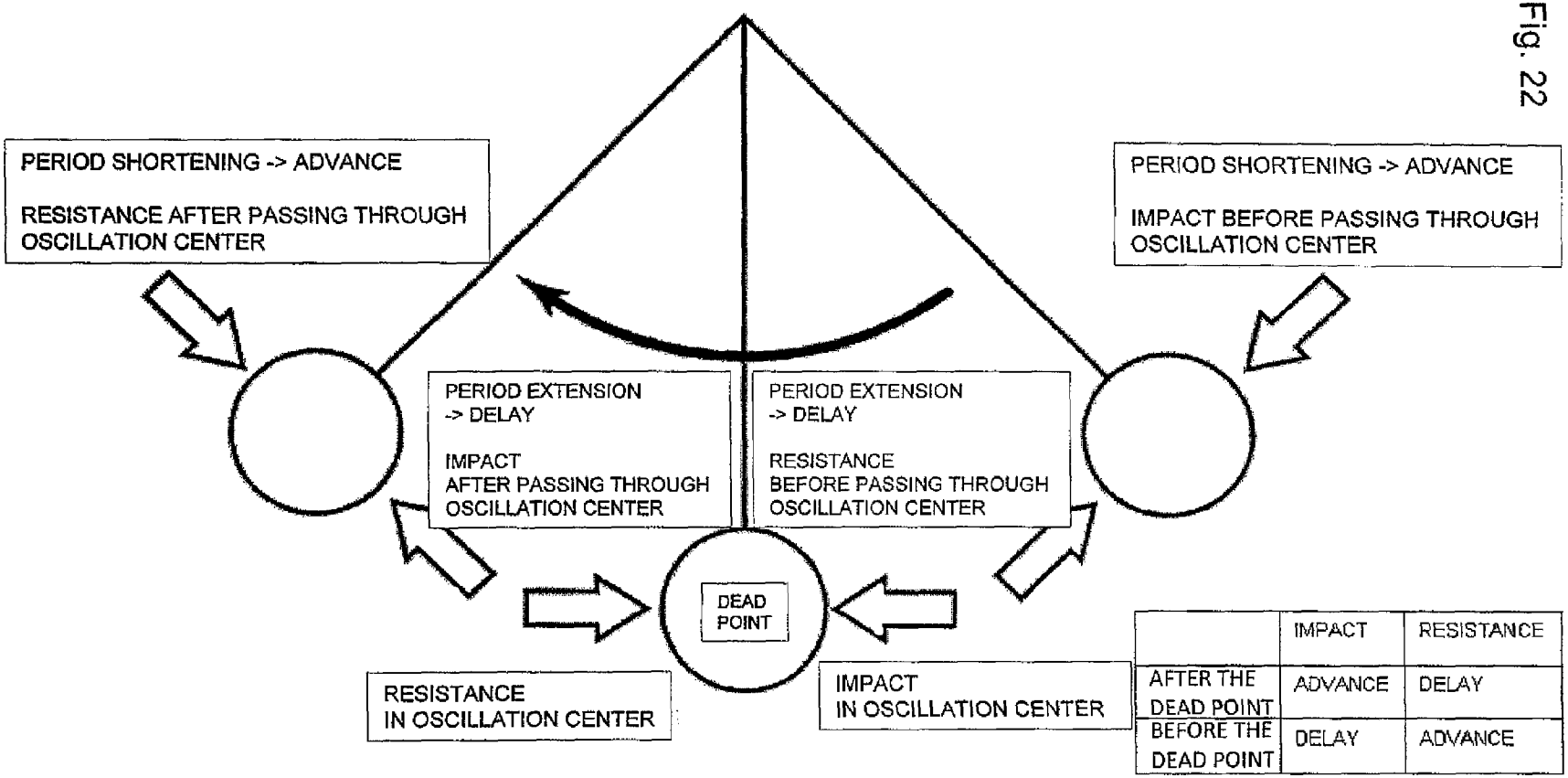
FIG. 22 is a principle view for explaining the Airy's theorem.

(5) Results of Comparison and Review of Operation of Detent Escapement of the Present Invention and Operation of Comparative Example Referring to FIGS. 18(*a*) and 19(*a*), in the detent escapement of Comparative Example 1 corresponding to the configuration of the conventional detent escapement, the influence in which the timing rate is delayed is greater than the influence in which the timing rate is advanced. In the configuration of Comparative Example 1, generally, in the case where significant delay of the timing rate is generated, after the balance crosses over the dead point position, the resistance (torque) which is applied to the balance by the release of the blade and the impact (torque) which is applied to the balance from the escape wheel and pinion are generated and ended. On the other hand, in the configuration of Comparative Example 1, the resistance (torque) which is applied to the balance by the release of the single blade spring is generated before the balance crosses over the dead point position.

Referring to FIGS. 18(*b*) and 19(*b*), one embodiment (corrected example) of the detent escapement of the present invention is configured so that the influence in which the timing rate is delayed is equal to the influence in which the timing rate is advanced. That is, in the embodiment of the present invention, generally, the influence in which the timing rate is delayed and the influence in which the timing rate is advanced are completely countervailed. In the embodiment of the present invention, the resistance (torque) which is applied to the balance is generated by the release of the blade, and the resistance ends before the balance passes through the dead point position. In the impact (torque) which is applied to the balance from the escape wheel and pinion, the balance passes through the dead point position within the range in which the impact (torque) is generated. On the other hand, the embodiment of the present invention, the resistance (torque) which is applied to the balance by the release of the single blade spring is generated after the balance crosses over the dead point position.

Referring to FIGS. 18(*c*) and 19(*c*), in the detent escapement of Comparative Example 2 including the balance in which the unlocking jewel is fixed at the position of 60° in the counterclockwise direction from the rotation reference line in the position toward the direction far from the escape wheel and pinion based on the rotation reference line, the influence in which the timing rate is delayed is smaller than the influence in which the timing rate is advanced. In the configuration of Comparative Example 2, generally, in the case where significant advance of the timing rate is generated, before the balance crosses over the dead point position, the resistance (torque) which is applied to the balance by the release of the blade and the impact (torque) which is applied to the balance from the escape wheel and pinion are generated and terminated. On the other hand, in the configuration of Comparative Example 2, the resistance (torque) which is applied to the balance by the release of the single blade spring is generated after the balance crosses over the dead point position.

(6) Test Results of Enlarged Model

With respect to the detent escapement of the present invention, an enlarged model of the escapement portion, which is configured so as to be an enlarged size compared to a size of a general watch, was prepared, and the comparative test was performed.

(6-1) Size of Enlarged Model

Sizes of main components in the enlarged model are as follows.

Diameter of Escape Wheel and Pinion: 41 (mm);

Moment of Inertia of Balance: $5.329*10^{-5}$ (kg·m$^2$)

Diameter of Trajectory of Tip of Unlocking Jewel: 7.19 (mm);

Diameter of Trajectory of Tip of Impulse pin: 27.39 (mm);

Center Distance between Rotation Center of Escape Wheel and Pinion and Rotation Center of Balance: 33.2 (mm);

Center Distance between Rotation Center of Balance and Rotation Center of Blade: 56.32 (mm);

Length of Straight Line Portion of Spring portion of Single Blade Spring: 32.15 (mm);

Impact Angle: 34°

Distance from Position of Balance Rotation Center in Which Unlocking Jewel Receives Resistance from Blade or Single Blade Spring: 7.07 (mm)

(6-2) Graph Showing Test Results

Figure 16:
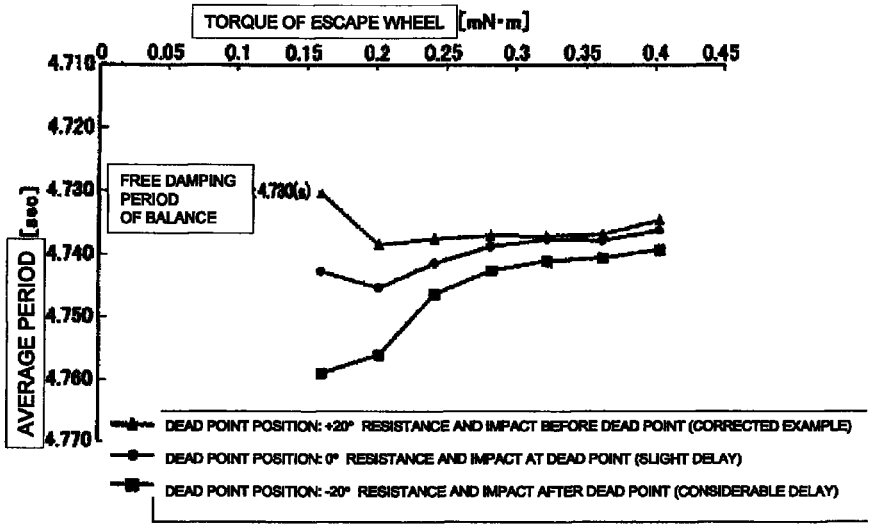
FIG. 16 is a graph showing test results from a ten times size model of the escapement in the embodiment of the detent escapement of the present invention.

Referring to FIG. 16, FIG. 16 is a graph showing test results of the enlarged model of the escapement. In FIG. 16, in the above conditions, the dead point position of the balance is changed to three parameters of 0° (position corresponding to the related art), +20° (position corresponding to one corrected example in the embodiment of the present invention), and −20° (Comparative Example which is set in the direction opposite to one corrected example in the embodiment of the present invention), in each of the dead point positions, the impact torque which receives from the escape wheel and pinion and the period change of the balance are shown when the impact torque receiving from the escape wheel and pinion is changed to eight points of 0.403 [mN·m], 0.3628 [mN·m], 0.3225 [mN·m], 0.282 [mN·m], 0.2419 [mN·m], 0.202 [mN·m], 0.1613 [mN·m], and 0.1209 [mN·m]. In FIG. 16, the horizontal axis shows the torque [mN·m] of the escape wheel and pinion, and the vertical axis shows the average period (sec) of the balance.

(6-3) Evaluation Reference of Enlarged Model Test

In the test of the enlarged model, when correction of the dead point position with respect to the oscillation period of a free damping of the balance is performed in each of values of the impact torques which the balance receives from the escape wheel and pinion, it is confirmed whether or not the change in the oscillation period of the balance can be suppressed to be smaller.

(6-4) Evaluation Results of Enlarged Model Test

As a result of the test of the enlarged model, it was confirmed that the change of the oscillation period of the balance could be suppressed to be smaller with respect to the oscillation period of the free damping of the balance by correcting the dead point position of the balance to +20°. Moreover, it was confirmed that there was an effect suppressing the change of the oscillation period of the balance according to the torque change by correcting the dead point position of the balance to +20°.

On the other hand, if the dead point position of the balance is set to −20°, the change of the oscillation period of the balance with respect to the oscillation period of the free damping of the balance becomes greater, and it was confirmed that the change of the oscillation period of the balance according to the torque change also became greater.

(7) Simulation Results

With respect to the detent escapement of the present invention, a simulation model was designed and comparison and review thereof were performed.

(7-1) Equation of Motion

An equation of motion showing a free oscillation of a friction system and a viscosity system of one degree of freedom is indicated by the following equation 1.

[Equation 1]

$$I\frac{d^2\theta}{dt^2} + F\frac{d\theta}{dt} + k\theta \pm R = T \tag{1}$$

θ: rotation angle of balance (rad);

I: moment of inertia of balance (kg·$^2$);

F: viscosity coefficient (kg·m$^2$/s);

k: spring constant of hairspring (kg m$^2$/s$^2$);

R: solid friction resistance (kg m$^2$/s$^2$);

T: total sum of impact torque from escape wheel and pinion, blade release which is received by balance, and resistance torque at the time of release of a single blade spring which are applied to the balance during one period (kg m$^2$/s$^2$).

A simulation model in which the timing at which T is given as a function of θ and (components of the resistance/impact before and after the dead point) are generated during one period was changed, was prepared, and the simulation of the operation of the escapement was performed.

(7-2) Size of Simulation Model

The size of each component is set so as to approximately correspond to the component size of the general watch.

Number of Teeth of Escape Wheel and Pinion: 15

Resistance Torque Which Is Received by Balance At the Time of Blade Release: $0.252*10^{-6}$ N·m;

Resistance Torque Which Is Received by Balance At the Time of Single Blade Spring Release: $0.044*10^{-6}$ N·m;

(7-3) Graph Showing Simulation Results

Figure 17:
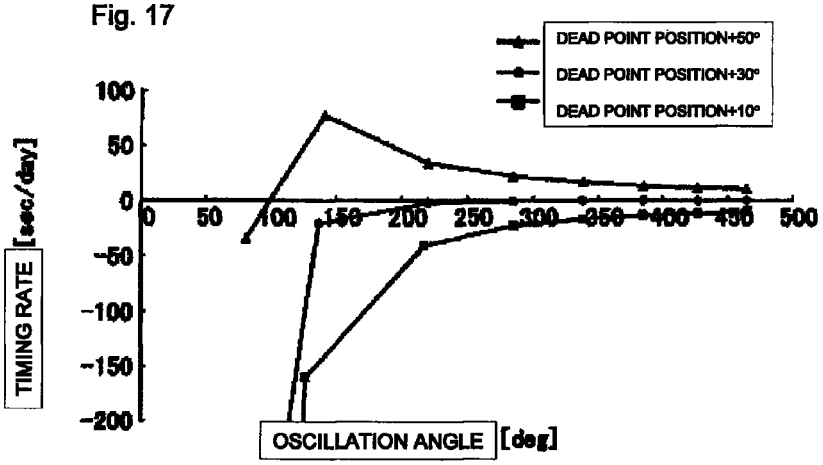
FIG. 17 is a graph showing simulation results in the embodiment of the detent escapement of the present invention.

FIG. 17 is a graph showing the simulation results of the simulation model of the escapement. In FIG. 17, in the above-described conditions, the corrected dead point positions of the balance are changed to three parameters of +10°, +30°, and +50°, and the results in which the values of the timing rate of the timepiece (number of seconds in which the timepiece is delayed or advanced during one day: sec/day) when the oscillation angle of the balance is 200° or more are simulated with a value of 50 (sec/day) are shown. In FIG. 17, the horizontal axis shows the oscillation angle (deg) of the balance and the vertical axis shows the timing rate (sec/day) of the timepiece.

(7-4) Evaluation Reference of Simulation

In the simulation, it is confirmed whether or not the timing rate of the timepiece (number of seconds in which the timepiece is delayed or advanced during one day: sec/day) is within 50 (sec/day) when the oscillation angle of the balance is 200° or more.

(7-5) Evaluation Results of Simulation

As a result of the simulation, by correcting the dead point position of the balance to be set between +10° and +50°, it was confirmed that the timing rate of the timepiece could be within 50 sec/day when the oscillation angle of the balance was 200° or more.

(7-6) Conclusion of Test Results and Simulation Results

From the test results and the simulation results, it was confirmed that the corrected amount of the dead point position of the balance could be set to +10° to +50° as a range which satisfies a general and practical timing rate (the timing rate of the timepiece is within 50 sec/day when the oscillation angle of the balance is 200° or more). Moreover, from the test results and the simulation results, it was confirmed that the corrected +20° to +30° was an appropriate range as the corrected amount of the general dead point position of the balance. In addition, also from results in which the same simulation was performed in values other than the above-described value of the resistance torque received by the balance, it is confirmed that +20° to +30° is an appropriate range as the corrected amount of the dead point position of the balance.

(8) Mechanical Timepiece including Detent Escapement of the Present Invention

In addition, in the present invention, the mechanical timepiece is configured so as to include the mainspring which configures a driving source of the mechanical timepiece, the front train wheel which is rotated by a turning force when the mainspring is rewound, and the escapement for controlling the rotation of the front train wheel, wherein the escapement is configured of the detent escapement. According to this configuration, escapement error is significantly small, and the mechanical timepiece having improved transmission efficiency of the force of the escapement can be realized. In addition, in the mechanical timepiece of the present invention, the mainspring can be smaller, or a long-lasting mechanical timepiece can be realized by using a barrel drum of the same size.

Figure 7A:
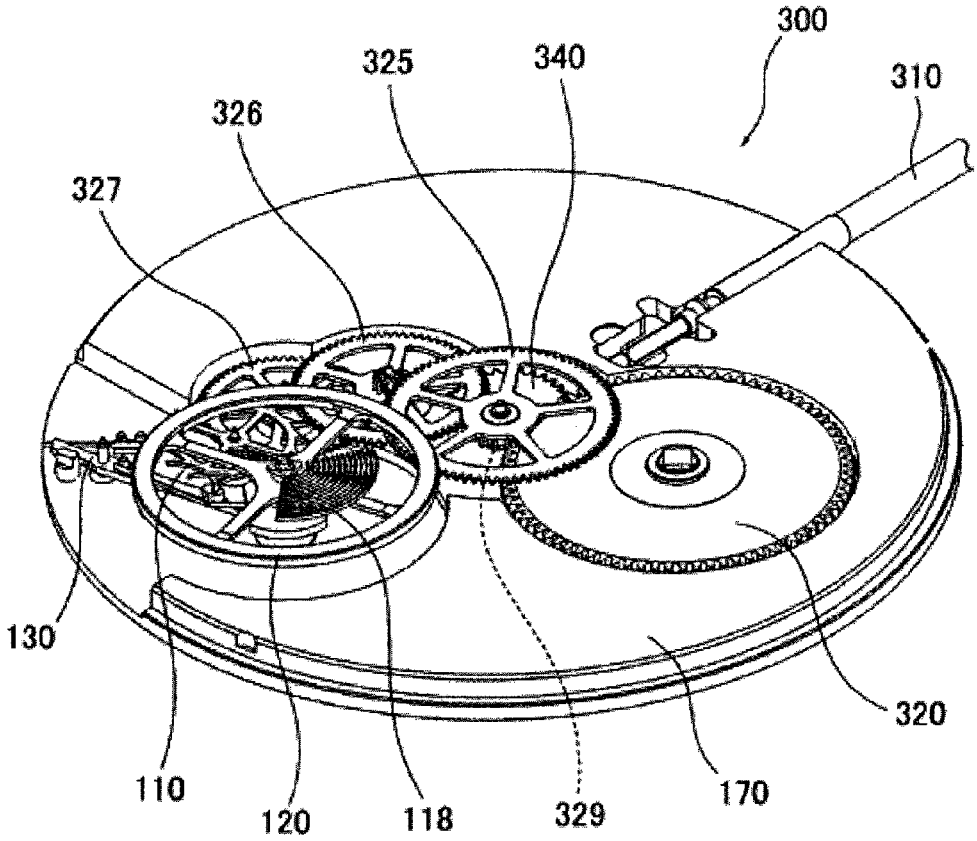
FIG. 7A is a perspective view showing the structure such as the front train wheel and the escapement in the embodiment of the mechanical timepiece which uses the detent escapement of the present invention.

Referring to FIGS. 7 and 7A, the movement (machine body) 300 includes the main plate 170 which configures the substrate of the movement 300. A winding stem 310 is disposed in the "three o'clock direction" of the movement 300. The winding stem 110 is rotatably incorporated into a winding stem guide hole of the main plate 170. The detent escapement which includes the balance 120, the escape wheel and pinion 110, and the blade 130 and the front train wheel which includes a second wheel & pinion 327, a third wheel & pinion 326, a center wheel & pinion 325, and a movement barrel 320 are disposed on the "front side" of the movement 100. A switching mechanism (not shown) which includes a setting lever, a yoke, and a yoke holder is disposed on the "back side" of the movement 300. Moreover, a barrel bridge (not shown) which rotatably supports the upper shaft portion of the movement barrel 320, a train wheel bridge (not shown) which rotatably supports the upper shaft portion of the third wheel & pinion 326, the upper shaft portion of the second wheel & pinion 327, and the upper shaft portion of the escape wheel 110, a blade bridge (not shown) which rotatably supports the upper shaft portion of the blade 130, and a balance bridge 180 which rotatably supports the upper portion of the balance 120 are disposed on the "front side" of the movement 300.

The center wheel & pinion 325 is configured so as to be rotated by the rotation of the movement barrel 320. The center wheel & pinion 325 includes a center wheel and a center pinion. A barrel drum wheel is configured so as to be engaged with the center pinion. The third wheel & pinion 326 is configured so as to be rotated by the rotation of the center wheel & pinion 325. The third wheel & pinion 326 includes a third wheel and a third pinion. The second wheel & pinion 327 is configured so as to rotate once per minute as a result of the rotation of the third wheel & pinion 326. The second wheel & pinion 327 includes a second wheel and a second pinion. The third wheel is configured so as to be engaged with the second pinion. According to the rotation of the second wheel & pinion 327, the escape wheel 110 is configured so as to rotate while being controlled by the blade 130. The escape wheel 110 includes an escape wheel and an escape pin. The second wheel is configured so as to be engaged with the escape pin. A minute wheel 329 is configured so as to rotate according to the rotation of the movement barrel 320. The movement barrel 320, the center wheel & pinion 325, the third wheel & pinion 326, the second wheel & pinion 327, and the minute wheel 329 configures the front train wheel.

A minute wheel 340 is configured so as to be rotated based on the rotation of a scoop pinion 329 which is mounted on the center wheel & pinion 325. A scoop wheel (not shown) is configured so as to be rotated based on the rotation of the minute wheel 340. According to the rotation of the center wheel & pinion 325, the third wheel & pinion 326 is configured so as to be rotated. According to the rotation of the third wheel & pinion 326, the second wheel & pinion 327 is configured so as rotate once a minute. The scoop wheel is configured so as to rotate once every twelve hours. A slip mechanism is provided between the center wheel & pinion 325 and the scoop pinion 329. The center wheel & pinion 325 is configured so as to rotate once per one hour.

INDUSTRIAL APPLICABILITY

The detent escapement of the present invention can be configured so that escapement error is significantly decreased. Moreover, the mechanical timepiece of the present invention is not easily subjected to the influence of disturbance. Therefore, the detent escapement of the present invention can be widely applied to a mechanical watch, a marine chronometer, a mechanical clock, a mechanical wall timepiece, a large mechanical street timepiece, a tourbillon escapement which mounts the detent escapement of the present invention, a watch having the detent escapement of the present invention, or the like.

| Description of Reference Numerals and Signs | |
|---|---|
| 100: | detent escapement |
| 110: | escape wheel and pinion |
| 118: | hairspring |
| 120: | balance |
| 122: | impulse pin |
| 124: | unlocking jewel |
| 130: | blade |
| 132: | locking jewel |
| 140: | single blade spring |
| 150: | balance spring |
| 170: | main plate |
| 300: | movement (machine body) |
| 320: | movement barrel |
| 325: | center wheel & pinion |
| 326: | third wheel & pinion |
| 327: | second wheel &pinion |

The invention claimed is:

1. A detent escapement for a timepiece, the detent escapement comprising:

an escape wheel and pinion;

a balance having an impulse pin for contacting a tooth portion of the escape wheel and pinion, and having an unlocking jewel;

a blade having a locking jewel for contacting the tooth portion of the escape wheel and pinion; and a single blade spring provided on the blade for contacting the unlocking jewel;

wherein a tip of the single blade spring contacting the unlocking jewel of the balance and applying resistance to the balance before the unlocking jewel of the balance passes through an oscillation center is defined as "resistance before dead point", wherein the tooth portion of the escape wheel and pinion contacting the impulse pin of the balance and applying force with respect to an advancing direction of the balance before the unlocking jewel of the balance passes through the oscillation center is defined as "impact before dead point", wherein the tooth portion of the escape wheel and pinion pressing the impulse pin of the balance and applying a force with respect to an advancing direction of the balance after the unlocking jewel of the balance passes through the oscillation center is defined as "impact after dead point", wherein the tip of the single blade spring contacting the unlocking jewel of the balance and applying resistance to the balance after the unlocking jewel of the balance passes through the oscillation center, and the tip of the blade spring contacting the unlocking jewel of the balance and applying resistance to the balance when the unlocking jewel of the balance passes through the oscillation center, returns toward the oscillation center, and the unlocking jewel of the balance passes through the oscillation center are defined as "resistance after dead point", wherein a straight line, defined as a rotation center line, passes through a rotation center of the blade and through a rotation center of the balance in a state where the unlocking jewel of the balance is positioned at the oscillation center, and wherein in a state where the unlocking jewel is positioned at the oscillation center, the unlocking jewel is disposed at a position in which the unlocking jewel is rotated by a preselected angle from the rotation reference line toward a direction away from the escape wheel and pinion so that the sum of influences that advance the timing rate of the timepiece, including the sum of the influence on the rotational movement of the balance which is generated by "impact before dead point" and the influence on the rotational movement of the balance which is generated by "resistance after dead point", and the sum of influences that delay the timing rate of the timepiece, including the sum of the influence on the rotational movement of the balance which is generated by "resistance before dead point" and the influence on the rotational movement of the balance which is generated by "impact after dead point" are balanced to each other.

2. The detent escapement according to claim 1, wherein the unlocking jewel of the balance is disposed between a position in which the unlocking jewel is rotated by 10° from the rotation reference line and a position in which the unlocking jewel is rotated by 50° from the rotation reference line toward the direction away from the escape wheel and pinion.

3. A mechanical timepiece comprising: a mainspring providing a driving source of the mechanical timepiece; a front train wheel which is rotated by a turning force when the mainspring is rewound; and a detent escapement according to claim 2 for controlling the rotation of the front train wheel.

4. The mechanical timepiece according to claim 3, wherein the balance of the detent escapement has a hairspring, an outer end of the hairspring being fixed to a stud provided so as to be able to rotate with respect to a balance bridge; and wherein the mechanical timepiece is configured so as to be able to change the position of the unlocking jewel and the position of the impulse pin with respect to the rotation reference line by rotating the stud with respect to the balance bridge.

5. The mechanical timepiece according to claim 4, further comprising rotatable range indicating means for indicating a range through which the stud can be rotated.

6. The detent escapement according to claim 1, wherein the unlocking jewel of the balance is disposed at a position in which the unlocking jewel is rotated by 20° to 30° from the rotation reference line toward the direction away from the escape wheel and pinion.

7. A mechanical timepiece comprising: a mainspring providing a driving source of the mechanical timepiece; a front train wheel which is rotated by a turning force when the mainspring is rewound; and a detent escapement according to claim 6 for controlling the rotation of the front train wheel.

8. The mechanical timepiece according to claim 7, wherein the balance of the detent escapement has a hairspring, an outer end of the hairspring being fixed to a stud provided so as to be able to rotate with respect to a balance bridge; and wherein the mechanical timepiece is configured so as to be able to change the position of the unlocking jewel and the position of the impulse pin with respect to the rotation reference line by rotating the stud with respect to the balance bridge.

9. The mechanical timepiece according to claim 8, further comprising rotatable range indicating means for indicating a range through which the stud can be rotated.

10. A mechanical timepiece comprising: a mainspring providing a driving source of the mechanical timepiece; a front train wheel which is rotated by a turning force when the mainspring is rewound; and a detent escapement according to claim 1 for controlling the rotation of the front train wheel.

11. The mechanical timepiece according to claim 10, wherein the balance of the detent escapement has a hairspring, an outer end of the hairspring being fixed to a stud provided so as to be able to rotate with respect to a balance bridge; and wherein the mechanical timepiece is configured so as to be able to change the position of the unlocking jewel and the position of the impulse pin with respect to the rotation reference line by rotating the stud with respect to the balance bridge.

12. The mechanical timepiece according to claim 11, further comprising rotatable range indicating means for indicating a range through which the stud can be rotated.

13. The mechanical timepiece according to claim 1, wherein the balance has a hairspring, an outer end of the hairspring being fixed to a stud provided so as to be able to rotate with respect to a balance bridge of the unlocking jewel; and wherein the stud is fixed to a stud support that is mounted to undergo rotation by a preselected angle with respect to the balance bridge so that the stud is rotated relative to the balance bridge and the unlocking jewel can be disposed at the position in which the unlocking jewel is rotated by a preselected angle from the rotation reference line toward the direction away from the escape wheel and pinion.

* * * * *